US006787280B2

(12) United States Patent
Yamashita et al.

(10) Patent No.: US 6,787,280 B2
(45) Date of Patent: Sep. 7, 2004

(54) ELECTROPHOTOGRAPHIC TONER AND METHOD OF PRODUCING SAME

(75) Inventors: Hiroshi Yamashita, Numazu (JP); Tsunemi Sugiyama, Numazu (JP); Shinichiro Yagi, Numazu (JP); Hiroshi Yamada, Numazu (JP); Masami Tomita, Numazu (JP); Toshiki Nanya, Mishima (JP); Shigeru Emoto, Numazu (JP); Naohiro Watanabe, Sunto-gun (JP); Tadao Takigawa, Shinshiro (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/286,791

(22) Filed: Nov. 4, 2002

(65) Prior Publication Data

US 2003/0162112 A1 Aug. 28, 2003

(30) Foreign Application Priority Data

Nov. 2, 2001 (JP) ..... 2001-338348

(51) Int. Cl.[7] ..... G03G 9/08; G03G 13/08

(52) U.S. Cl. ..... 430/111.4; 430/108.6; 430/108.7; 430/120; 430/137.15

(58) Field of Search ..... 430/111.4, 137.1, 430/109.4, 108.6, 108.7, 120, 45, 137.15

(56) References Cited

U.S. PATENT DOCUMENTS

| | | | | |
|---|---|---|---|---|
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,403,275 | B1 | 6/2002 | Kuramoto et al. | |
| 6,432,589 | B1 | 8/2002 | Uchinokura et al. | |
| 6,432,599 | B1 * | 8/2002 | Yuasa et al. | 430/108.4 |
| 6,436,599 | B1 * | 8/2002 | Matsuoka et al. | 430/137.19 |
| 6,458,502 | B1 * | 10/2002 | Nakamura et al. | 430/137.17 |
| 6,468,706 | B2 | 10/2002 | Matsuda et al. | |
| 6,503,676 | B2 * | 1/2003 | Yamashita et al. | 430/108.3 |

FOREIGN PATENT DOCUMENTS

| | | |
|---|---|---|
| JP | 8-91612 | 4/1996 |
| JP | 10-139197 | 5/1998 |
| JP | 2001-217675 | 8/2001 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner for developing an electrostatic image, comprising toner particles each containing at least a colorant and a resin, and an external additive present on each of the toner particles, wherein the water wettability of said toner particles without the external additive is $W_0$, wherein the water wettability of the toner is $W_{100}$, and wherein $(W_{100}-W_0)/W_{100}$ is not greater than 0.3.

49 Claims, No Drawings

ELECTROPHOTOGRAPHIC TONER AND METHOD OF PRODUCING SAME

BACKGROUND OF THE INVENTION

The present invention relates to a toner for use in a developer for developing an electrostatic image in electrophotography, electrostatic recording, electrostatic printing and so on, a method for producing the toner, and a developing method using the toner. More particularly, the present invention relates to an electrophotographic toner for use in an apparatus, such as a copying machine, a laser printer or a plain paper facsimile machine, employing a direct or indirect electrophotographic developing system, and in an apparatus, such as a full-color copying machine, a full-color laser printer and a full-color plain paper facsimile machine, employing an electrophotographic multi-color developing system, a method for producing the toner and a developing method using the toner.

A developer for use in electrophotography, electrostatic recording, electrostatic printing and so on is attached to an image carrier such as a photoconductor on which an electrostatic image has been formed in a developing process, then transferred from the photoconductor to a transfer medium such as a transfer paper in a transfer process, and fixed on the paper in a fixing process. As the developer for developing the electrostatic image formed on a latent image holding surface of the image carrier, a two-component developer comprising a carrier and a toner and a one-component developer requiring no carrier (magnetic or nonmagnetic toner) are known.

As a dry toner for use in electrophotography, electrostatic recording, electrostatic printing and so on, a toner obtained by melt-kneading a toner binder such as a styrene resin or polyester together with a colorant and so on and finely pulverizing the kneaded mixture is conventionally used.

For the purpose of producing an image with high fineness and high quality, improved toners having a small particle size have been proposed. However, particles of a toner produced by a normal kneading-pulverizing method have irregular shapes. Thus, the toner particles may be further pulverized into superfine particles or a fluidizing agent is buried in the surfaces of the toner particles when the toner is agitated with a carrier in a developing unit or when, in the case of being used as a one-component developer, the toner particles receive a contact stress from a developing roller, a toner supply roller, a layer thickness regulating blade, a frictional electrification blade and so on, resulting in deterioration of image quality. Also, the toner is poor in fluidity as a powder because of the irregular shapes of the particles thereof, and thus requires a large amount of fluidizing agent or cannot be filled in a toner bottle with a high filling rate, which makes it difficult to downsize the apparatus. Thus, the advantage of small-seized particles is not fully utilized. Also, a kneading-pulverizing method has a limit on the particle size that it can produce and cannot meet the requirement for smaller sized toner particles.

Additionally, the process of transferring an image formed of color toners from a photoconductor to a transfer medium or a paper to produce a full-color image is becoming more complicated, so that low transferability of a pulverized toner due to the irregular shapes of the particles thereof causes a void in a transferred image or an increase in consumption of toners to prevent it.

Thus, there is an increasing demand for producing a high quality image without a void while reducing consumption of toners and decreasing running cost by improving transfer efficiency. When transfer efficiency is significantly high, there is no need for a cleaning unit for removing untransferred toner from a photoconductor and a transfer medium, which leads to downsizing of the apparatus and cost reduction. This has also a merit of generating no waste toner. For the purpose of overcoming the drawbacks of the toner of irregular particle shape, there have been proposed various methods for producing a toner of spherical particles. However, a spherical toner has the following problems.

Spherical toner particles can be produced by suspension polymerization or emulsion polymerization. However, there is a limitation on the type of the resin that can be used in these methods, so that the toner particles are not suitable for a full-color process. Especially, a toner for use in a full-color copying machine or a full-color printer must have a low melt viscosity to provide gloss and color mixability in a printed image and thus contains a polyester type toner binder having a sharp melt property. It is difficult for a toner obtained by suspension polymerization or emulsion polymerization of a vinyl polymer to produce such properties.

Since a toner containing a polyester type toner binder having a sharp melt property is likely to cause hot offset, a silicone oil or the like is conventionally applied to a heat roll in full-color machines. However, in order to apply a silicone oil to a heat roll, an oil tank and an oil applying unit are necessary, which makes the apparatus unavoidably complicated and large. Also, application of oil causes deterioration of the heat roll, so that the heat roll needs regular maintenance. Additionally, it is unavoidable for the oil to adhere a copying paper and an OHP (overhead projector) film. Especially, the oil adhered to OHP films impairs color tone of printed images.

As a method to overcome the problems, Japanese Laid-Open Patent Publications No. H07-152202, H09-015903, H11-133665 and H11-149179 disclose a method involving volume shrinkage, called polymer solution suspension method. The method comprises the steps of dispersing and dissolving toner ingredients in a volatile solvent such as a low-melting point organic solvent, emulsifying and granulating the composition in an aqueous medium containing a dispersing agent, and removing the volatile solvent. This method can use a wide variety of resin materials and can be applied to production of a full-color toner as well as a monochrome toner. Also, this method can produce a various shapes of particles with the use of, for example, a water-insoluble solid fine powder dispersing agent although it involves a volume shrinkage of the granules during the production process. However, in producing particles in an aqueous medium by a polymer suspension method, as in the case with suspension polymerization or emulsion polymerization, a polar material such as a suspension stabilizer, emulsion stabilizer or surfactant must be used to stably produce particles in the aqueous medium. Such a polar material, which cannot be easily removed by a simple washing method and remains on the surfaces of the resulting toner particles, adversely affects the charging properties of the toner, especially under high temperature and high humidity. Also, the polar material remaining on the surfaces of the toner particles adheres to a surface of a photoconductor in developing or cleaning and causes a blur of a latent image formed thereon (at worse, the image flows and becomes indistinguishable). Especially, when an image is formed by dots in a digital machine, this tendency is strong when the diffusion rate of the latent image is low.

Thus, in order to obtain a consistent image quality in any environment, the photoconductor must be heated to prevent effects of humidity and adhesion of the polar material thereto, especially in a machine for producing high-quality images.

SUMMARY OF THE INVENTION

The objects of the present invention are as follows:

(1) To provide a toner which is produced, in an aqueous medium, from a toner composition dispersed and dissolved in an organic solvent, which can be charged stably in any environment, and which can consistently produce high-quality images.

(2) To provide a method for producing the above toner.

(3) To provide a developing method and a multi-color developing method using the above toner, which cause less contamination of a photoconductor even when the photoconductor is not heated and which can consistently produce high-quality images.

Particles prepared by a solution suspension method shrink upon removing the solvent. Thus, a dispersing agent (a surfactant, protective colloid such as a water-soluble polymer or solid fine powder) used to stabilize oil droplets attached to the surfaces of the particles tends to be drawn into the particles. This is thought to be because the dispersing agent adsorbed at the interface between oil and water is drawn into the particles due to the decrease of the area of the interface at the time of the shrinkage. The tendency of the dispersing agent to be drawn into the particles depends upon various factors such as the HLB, polarity, particle size and solubility of the dispersing agent. Thus, it is important to select a dispersing agent which is unlikely to remain in and on the toner particles or which causes little adverse effect even if it remains in and on the toner particles and to perform sufficient washing to remove the dispersing agent. For example, a solid dispersing agent which dissolves or swells in an acid or alkali is preferred. Especially, fine particles of a resin having a carboxyl group or a sulfone group are preferred. These dispersing agents can be removed by treatment with an alkali or acid before or after the removal of the solvent. In addition, the criteria to judge what properties are required for the resulting toner particles to have stable charging properties under various environments and to cause less photoconductor contamination were not known. As a result of zealous studies of evaluating the water wettability of toner particles, the present inventors found the rate of change in water wettability of toner particles before and after being mixed with an external additive to be an important control factor and has accomplished the present invention.

According to one aspect of the present invention, there is provided a toner for developing an electrostatic image, comprising toner particles each containing at least a colorant and a resin, and an external additive present on each of the toner particles, wherein the water wettability of the toner particles without the external additive is $W_0$, wherein the water wettability of the toner is $W_{100}$, and wherein $(W_{100}-W_0)/W_{100}$ is not greater than 0.3.

In another aspect of the present invention, there is provided a toner for developing an electrostatic image, comprising toner particles each containing at least a colorant and a resin, and an external additive present on each of the toner particles, wherein the water wettability of the toner particles from which greater than 0% and not greater than 50% of the external additive is removed is $W_{50}$, wherein the water wettability of the toner is $W_{100}$, and wherein $(W_{100}-W_{50})/W_{100}$ is not greater than 0.3.

According to still another object of the present invention, there is provided a toner for developing an electrostatic image, comprising toner particles each containing at least a colorant and a resin, and an external additive present on each of the toner particles, wherein the water wettability of the toner particles from which greater than 50% and not greater than 70% of the external additive is removed is $W_{30}$, wherein the water wettability of the toner is $W_{100}$, and wherein $(W_{100}-W_{30})/W_{100}$ is not greater than 0.3.

The present invention also provides an electrostatic image developing method comprising developing an electrostatic latent image is formed on a surface of a photoconductor which does not have a function of maintaining the surface at a temperature of 30° C. or higher with a developer containing a toner according to the above-described one aspect of the present invention in a developing device having a developing roll and a developing blade for making the thickness of developer supplied on the developing roll uniform.

The present invention also provides a developing method comprising developing a plurality of color-separated electrostatic latent images formed on a surface of a photoconductor which does not have a function of maintaining the surface at a temperature of 30° C. or higher with developers each containing a toner corresponding to the respective color in a developing device having a developing roll and a developing blade for making the thickness of developer supplied on the developing roll uniform, wherein the above-described toner is used as the toner.

The present invention also provides a method for producing a toner for developing an electrostatic image, comprising the steps of dispersing a solution or dispersion, formed by dissolving or dispersing a toner composition comprising at least a colorant and a resin in an organic solvent, in an aqueous medium to obtain a dispersion, removing the organic solvent from the thus obtained dispersion to obtain powder particles having a water wettability of $W_0$, and mixing the powder particles with an external additive to obtain a toner having a water wettability of $W_{100}$, wherein $(W_{100}-W_0)/W_{100}$ is not greater than 0.3.

The present invention also provides a method for producing a toner for developing an electrostatic image, comprising the steps of dispersing a solution or dispersion, formed by dissolving or dispersing a toner composition comprising at least a colorant and a resin in an organic solvent, in an aqueous medium containing a solid fine particle dispersing agent to obtain a dispersion, removing the organic solvent from the thus obtained dispersion to obtain powder particles having a water wettability of $W_0$, and mixing the powder particles with an external additive to obtain a toner having a water wettability of $W_{100}$, wherein $(W_{100}-W_0)/W_{100}$ is not greater than 0.3.

The present invention also provides a method for producing a toner for developing an electrostatic image, comprising the steps of dispersing a solution or dispersion, formed by dissolving or dispersing a toner composition comprising at least a colorant, a resin and a reactive prepolymer in an organic solvent, in an aqueous medium to obtain a solution or dispersion, subjecting the solution or dispersion to a polyaddition reaction with a compound having at least two functional groups capable of reacting with the reactive prepolymer to obtain a dispersion, and removing the organic solvent from the thus obtained dispersion to obtain powder particles having a water wettability of $W_0$, and mixing the powder particles with an external additive to obtain a toner having a water wettability of $W_{100}$, wherein $(W_{100}-W_0)/W_{100}$ is not greater than 0.3.

The present invention also provides a method for producing a toner for developing an electrostatic image, comprising the steps of dispersing a solution or dispersion, formed by dissolving or dispersing a toner composition comprising at least a colorant and a resin in an organic solvent, in an aqueous medium to obtain a dispersion, removing the organic solvent from the thus obtained dispersion to obtain powder particles having a water wettability of $W_0$, and mixing the powder particles with charge controlling agent particles and external additive particles to obtain a toner having a water wettability of $W_{100}$, wherein $(W_{100}-W_0)/W_{100}$ is not greater than 0.3.

As mentioned before, in the conventional toner, a dispersing agent used therein is apt to be drawn into the particles thereof and remain therein. Thus, the toner is easily wetted with water and poor in environmental stability before being mixed with an external additive. The solution of the problem is simply to adhere a hydrophobized external additive to the surfaces of the toner particles. The external additive is separated from the toner particles during use in an apparatus or selectively developed. When the external additive is separated from the toner particles, the charging properties of the toner are considerably deteriorated. In the present invention, the problem of poor environmental stability can be first solved by reducing the water wettability of the toner particles before being mixed with an external additive. Thus the toner has excellent charging properties, even though the toner particles are produced in water. According to the present invention, it has been found that when the rate of change in water wettability of toner particles before and after being made into a toner, namely, being mixed with an external additive (or the external additive is reduced therefrom), is 0.3 or lower, preferably 0.15 or lower, the toner can maintain high image quality even when the tobner particles are produced by a specific method by which a material with a high polarity is likely to adhere the surfaces thereof. When the rate is greater than 0.3, failures such as an image blur and background stains due to decrease in the amount of charge tend to occur under high temperature and high humidity conditions. As the methods of reducing the water wettability of the toner particles before being mixed with an external additive, the following methods have been found;

(1) To enhance washing of the toner particles, increase agitation energy in washing, or increase the number of times of washing to promote diffusion of the polarity material in water.

(2) To select a dispersing agent which is unlikely to adhere to toner particles. Solid fine particles and a surfactant balanced in HLB are preferred.

(3) To adjust the polarity of oil droplets by addition of a resin or solvent.

It is understood that toner particles which can provide a rate of change in water wettabiloty of 0.3 or lower can be obtained only by the emulsification dispersion in an aqueous medium at the moment.

Even when the reduction rate of the external additive is 30%, the image density is not changed and high quality images can be obtained in practical use under high temperature and high humidity conditions when the rate of change in water wettability is 0.3 or lower. Even when the reduction rate of the external additive is 50% or higher, an image without image deterioration having a quality comparable to that of an image produced using new toner can be produced with toner recycled in a machine when the rate of change in water wettability is 0.3 or lower.

The "toner particles without the external additive" herein means toner particles from the surfaces of which the external additive has been substantially removed by a method in which the toner particles are dispersed and stirred in water containing a surfactant and then separated and dried. More particularly, 10 g of a toner are dispersed in 100 g of ion-exchanged water containing 1% of sodium dodecylbenzenesulfonate with stirring. After stirring at room temperature for 5 hours, the dispersing agent is filtered. The filter cake is dispersed again in 100 g of ion-exchanged water and stirred at room temperature for 5 hours. This is then filtered and dried. The thus obtained toner particles are referred to as "toner particles without the external additive". When toner particles before being mixed with the external additive are feasible, the particles may be used as the "toner particles without the external additive".

To obtain a "toner particles in which the external additive is removed to a specific amount", the following external additive reduction treatment is performed.

A reduced amount of the external additive can be measured by X-ray fluorescence analysis. It is only necessary to create calibration curves for specific elements such as silicon and titanium using a toner containing a known amount of the external additive. More specifically, a known amount (0.1%, 0.3%, 0.6%, 1.2% and 2.4% by weight) of an external additive comprising silica and titanium oxide is mixed with a toner before being mixed with the external additive. 3 Grams of each mixture are shaped into a circular pellet with a diameter of 40 mm by applying a pressure of 6 tons/cm$^2$ for 1 minute. The pellet is analyzed with a fluorescence analyzer (a wavelength dispersive type fluorescent X-ray analytical device, RIX 3000, manufactured by Rigaku Corporation) and calibration curves for titanium oxide and silica are created by plotting the counts versus the weights of titanium and silicon. The external additive content of an unknown sample can be determined from the count obtained by analyzing a pellet of the sample shaped as above with the fluorescent X-ray analyzer.

The "toner particles from which greater than 0% and 50% or less of the external additive is removed" herein is as follows. A toner containing an external additive present on each of the particles thereof is measured for the amount $M_{100}$ of a specific component element used to discern the external additive (for example, silicon when the external additive is a silica type external additive, and titanium when the external additive is titanium dioxide) by the X-ray fluorescent analysis. Then the toner is subjected to the treatment to remove the external additive present on the particles thereof according to the above method. During the 5 hours' stirring, samples are taken at predetermined intervals, and each sample is measured for the amount of the specific component element by the X-ray fluorescent analysis. Each sample is filtered and dried, and then measured for the amount of the specific component element, which is taken as $M_{50}$. The "toner particles from which greater than 0% and 50% or less of the external additive is removed" means a toner which has been subjected to the treatment to remove the external additive until the residual rate of the specific component element $(M_{100}-M_{50})/M_{100}$ reaches between 0.50 to 0.99 (rounded off the number to the two decimal place).

The "toner particles from which greater than 50% and 70% or less of the external additive is removed" herein is as follows. A toner containing an external additive present on each of the particles thereof is measured for the amount $M_{100}$ of a specific component element used to discern the external additive (for example, silicon when the external additive is a silica type external additive, and titanium when the external additive is titanium dioxide) by the X-ray fluorescent analysis. Then the toner is subjected to the treatment to remove the external additive present on the particles thereof according to the above method. During the 5 hours' stirring, samples are taken at predetermined intervals, and each sample is measured for the amount of the specific component element by the X-ray fluorescent analysis. Each sample is filtered and dried, and then measured for the amount of the specific component element, which is taken as $M_{30}$. The "toner particles from which greater than 50% and 70% or less of the external additive is removed" means a toner which has been subjected to the treatment to remove the external additive until the residual rate of the specific component element $(M_{100}-M_{30})/M_{100}$ reaches between 0.30 to 0.49 (rounded off the number to the two decimal place).

The "water wettability" herein can be represented by the transmissivity of the dispersion of a sample in water. In the present invention, the absolute value of water wettability is of importance. Rather, the rate of change in water wettability between two samples is important. The rate of change in water wettability is measured as follows.

(Method for Determining Rate of Change in Water Wettability)

20 Grams of ion-exchanged water and 0.2 g of a sample having passed through a 50 $\mu$m sieve are charged in a 30 ml screw vial containing a magnetic stirrer with a diameter of 5 mm and a length of 15 mm in this order. The mixture is stirred at a stirring rate of 300 rpm for 4 hours, taking care so that powder floating on the water may not be entrained into the water by the magnetic stirrer.

Then, about 5 cc of the mixture is rapidly taken from a middle part in the vial using a pipette with a care not to suck particles floating on the liquid while stirring the mixture at a stirring rate of 300 rpm so that particles floating in the liquid may not sink. The thus obtained sample is measured for the transmissivity at once.

The parallel light transmissivity of the sample as measured with a direct-reading haze computer (HGM-20DP) manufactured by Suga Test Instrument Co., Ltd. is defined as the water wettability of the toner particles. When the water wettability of toner particle is $W_{100}$ and the water wettability of the toner particles without the external additive is $W_0$, the rate of change in wettability is $(W_{100}-W_0)/W_{100}$. When the water wettability of toner particle is $W_{100}$ and the water wettability of the toner particles from which greater than 0% and not greater than 50% of the external additive is removed is $W_{50}$, the rate of change in wettability is $(W_{100}-W_{50})/W_{100}$. When the water wettability of toner particle is $W_{100}$ and the water wettability of the toner particles from which greater than 0% and not greater than 70% of the external additive is removed is $W_{30}$, the rate of change in wettability is $(W_{100}-W_{30})/W_{100}$. In the present invention, at least one of the rates of change in water wettability is not greater than 0.3.

Other objects, features and advantages of the present invention will become apparent from detailed description of the preferred embodiments of the present invention to follow.

DETAILED DESCRIPTION OF THE PREFERRED EMBODIMENTS OF THE INVENTION

A toner composition (toner particles) containing a colorant and a resin of the present invention comprises the following component materials.

Illustrative of suitable binder resins are homopolymers of styrene or substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, styrene-acrylonitrile-indene terpolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. These polymers can be used alone or in combination.

A reactive prepolymer for use in the present invention is one which gives the binder resin by a polyaddition with a compound (polyvalent compound) having at least two, preferably two to three, functional groups capable of reacting with it. The functional groups in the prepolymer may be isocyanate groups, hydroxyl groups, carboxyl groups, amino groups, mercapto groups or the like. Above all, isocyanate groups are preferred. The prepolymer is preferably a polyester type prepolymer but may be another prepolymer such as a polyurethane type prepolymer.

The polyvalent compound capable of reacting with the reactive prepolymer is appropriately selected depending upon the type of the reactive functional groups in the prepolymer. For example, when the prepolymer contains isocyanate groups, amines are used as the polyvalent compound. When the prepolymer contains active hydroxyl groups such as amino groups or hydroxyl groups, polyisocyanate is used as the polyvalent compound.

One example of the combination of a reactive prepolymer and a compound (polyvalent compound) having at least two functional groups capable of reacting with the reactive prepolymer is (A) an isocyanate group-containing polyester prepolymer and (B) amines. An isocyanate group-containing polyester prepolymer (A) preferably used in the present invention is obtained by reacting a polyisocyanate (PIC) with a polyester prepared by polycondensation of a polyol (PO) with a polycarboxylic acid (PC) which has an active hydrogen group. Preferred examples of the active hydrogen group contained in the polyester include a hydroxyl group (alcoholic OH or phenolic OH), an amino group, a carboxyl group and a mercapto group. Above all, an alcoholic OH is preferred.

The polyol (PO) may be a diol (DIO) or a tri- or more polyhydric alcohol (TO). The use of a DIO or a mixture of a DIO with a minor amount of a TO is preferred.

Preferred examples of the diol include alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2–12 carbon atoms and alkylene oxide adducts of bisphenols are preferred. Especially preferred is the use of a mixture of an alkylene oxide adduct of a bisphenol with an alkylene glycol having 2–12 carbon atoms.

Preferred examples of the tri- or more polyhydric alcohol include polyhydric aliphatic alcohols having 3–8 or more hydroxyl groups such as glycerin, trimethylolethane, trimethylolpropane, pentaerythritol, and sorbitol; tri- or more polyphenols such as trisphenol PA, phenol novolak and cresol novolak; and alkylene oxide adducts of the above tri- or more polyphenols.

The polycarboxylic acid (PC) may be a dicarboxylic acid (DIC), or a tri- or more polybasic carboxylic acid (TC). The use of a dicarboxylic acid or a mixture of a dicarboxylic acid with a minor amount of a tri- or more polybasic carboxylic acid is preferred.

Preferred examples of the dicarboxylic acid include alkyldicarboxylic acids such as succinic acid, adipic and sebacic acid; alkenylene dicarboxylic acids such as maleic acid and fumaric acid; and aromatic dicarboxylic acids such as phthalic acid, isophthalic acid, terephthalic acid, and naphthalene dicarboxylic acid. Above all, alkenylene dicarboxylic acids having 4–20 carbon atoms and aromatic dicarboxylic acids having 8–20 carbon atoms are preferably used.

Preferred examples of the tri- or more polybasic carboxylic acid include aromatic polycarboxylic acids having 9–20 carbon atoms such as trimellitic acid and pyromellitic acid.

The polycarboxylic acids may be in the form of anhydrides or lower alkyl esters (e.g. methyl esters, ethyl esters and isopropyl esters).

In the formation of the polyester, the polyol and the polycarboxylic acid are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Preferred examples of the polyisocyanate include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as tolylene diisocyanate, diphenylmethane diisocyanate; araliphatic diisocyanates such as $\alpha,\alpha,\alpha',\alpha'$-tetramethylxylylene diisocyanate; isocyanurates; the above polyisocyanates blocked with phenol derivatives, oximes or caprolactams; and mixtures thereof.

The polyisocyanate is used in such an amount that the ratio [NCO]/[OH] of the equivalent of the isocyanate groups [NCO] to the equivalent of the hydroxyl groups [OH] of the polyester is in the range of generally 5:1 to 1:1, preferably 4:1 to 1.2:1, more preferably 2.5:1 to 1.5:1. When the [NCO]/[OH] ratio is over 5:1, the low-temperature fixation properties of the resulting toner are adversely affected. When the mole ratio of [NCO] is less than 1, the urea content in the modified polyester will be low and the anti-hot offset properties of the resulting toner are adversely affected.

The prepolymer terminated with an isocyanate group-containing polyester has a content of the polyisocyate unit in the range of generally 0.5–40% by weight, preferably 1–30% by weight, more preferably 2–20% by weight. Too small an isocyanate group content of less than 0.5% adversely affects the anti-hot offset properties of the resulting toner and poses a difficulty in simultaneously imparting satisfactory low-temperature fixation properties and heat resistive preservability to the resulting toner. When the isocyanate group content exceeds 40% by weight, the low-temperature fixation properties of the resulting toner are adversely affected.

The isocyanate group containing prepolymer (A) contains at least 1, preferably 1.5–3, more preferably 1.8–2.5 isocyanate groups per molecule. Too small the number of the isocyanate group of less than 1 per molecule will result in a urea-modified polyester having an excessively small molecular weight and the anti-hot offset properties of the resulting toner are adversely affected.

Preferred examples of the amines (B) include diamines (B1), tri- or more polyamines (B2), aminoalcohols (B3), aminomercaptans (B4), amino acids (B5) and blocked derivatives thereof (B6).

Illustrative of suitable diamines (B1) are aromatic diamines such as phenylenediamine, diethytoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable tri- or more polyamines (B2) are diethylenetriamine and triethylenetetramine. Illustrative of suitable aminoalcohols (B3) are ethanolamine and hydroxyethylaniline. Illustrative of suitable aminomercaptans (B4) are aminoethylmercaptan and aminopropylmercaptan. Illustrative of suitable amino acids (B5) are aminopropionic acid and aminocaproic acid. Illustrative of suitable blocked derivatives of the above amines (B6) are ketimine compounds obtained by reacting the amines B1 to B5 with a ketone such as acetone, methyl ethyl ketone or methyl isobutyl ketone. Oxazolidine compounds may be also used as the blocked derivatives. Especially preferred is the use of B1 or a mixture of a B1 with a minor amount of a B2.

If desired, a chain extension terminator may be used to control the molecular weight of the modified polyester. Preferred examples of the chain extension terminator include monoamines such as diethylamine, dibutylamine, butylamine and laurylamine; and blocked monoamines such as ketimine compounds.

The amines (B) are reacted with the isocyanate group-containing polyester prepolymer in such an amount that the ratio [NCO]/[$NH_x$] of the equivalent of the isocyanate groups [NCO] of the isocyanate group-containing prepolymer (A) to the equivalent of the amino groups [$NH_x$] of the amines (B) is in the range of generally 1:2 to 2:1, preferably 1.5:1 to 1:1.5, more preferably 1.2:1 to 1:1.2. A [NCO]/[$NH_x$] ratio over 2:1 or less than 1:2 will result in a urea-modified polyester having an excessively small molecular weight and the anti-hot offset properties of the resulting toner are adversely affected. In the present invention, the modified polyester may have a urea bond and/or a urethane bond. In the case of a polyester having both a urea bond and a urethane bond, the mole ratio of the urea bond content to the urethane bond content is generally 100/0 to 10/90, preferably 80/20 to 20/80, more preferably 60/40 to 30/70. When the mole ratio of the urea bond is less than 10%, the anti-hot offset properties of the resulting toner are adversely affected.

The modified polyester (MPE), such as a urea-modified polyester (UMPE), for use in the present invention may be prepared by a one-shot method or a prepolymer method. The modified polyester generally has a weight average molecular weight of at least 10,000, preferably 20,000 to $10^7$, more preferably 30,000 to $10^6$. Too small a weight average molecular weight of less than 10,000 adversely affects the anti-hot offset properties of the resulting toner. When the modified polyester is used by itself as the toner binder, the number average molecular weight thereof is generally 20,000 or less, preferably 1,000–10,000, more preferably 2,000–8,000. Too large a number average molecular weight above 20,000 adversely affects the low-temperature fixation properties of the resulting toner and gloss of color toner images. When the modified polyester is used in conjunction with a non-modified polyester (PE) as the toner binder, however, the number average molecular weight thereof is not specifically limited but may be arbitrarily determined in view of the above weight average molecular weight.

It is preferred that the modified polyester be used in conjunction with a non-modified polyester as the toner binder for reasons of low-temperature fixation properties of the toner and improved gloss of the toner images. The PE may be polycondensation products obtained from a polyol and a polycarboxylic acid. Suitable polyols and polycarboxylic acids are as described previously with reference to the MPE. A polyester modified by a chemical bond other than a urea bond and a urethane bond may be also used.

It is preferred that the MPE and PE be compatible with each other for reasons of low fixation properties and anti-hot offset properties of the toner. Thus, the polyester component of the MPE preferably has a structure similar to the PE.

When a PE is used in conjunction with an MPE, the weight ratio of the MPE to the PE is generally 5:95 to 80:20, preferably 5:95 to 30:70, more preferably 5:95 to 25:75, most preferably 7:93 to 20:80. Too small an amount of the MPE 5% by weight adversely affects the anti-hot offset properties of the resulting toner and poses a difficulty in simultaneously imparting satisfactory low-temperature fixation properties and heat resistive preservability to the resulting toner.

The main peak molecular weight of the unmodified polyester (PE) is generally 1,000 to 30,000, preferably 1,500 to 10,000, more preferably 2,000 to 8,000. When the main peak molecular weight is less than 1,000, the resulting toner has poor heat resistive preservability. When the main peak molecular weight is over 10,000, the resulting toner has poor low-temperature fixation properties.

The PE preferably has a hydroxyl value of at least 5, preferably 10–120, more preferably 20–80. Too low a hydroxyl value of less than 5 poses a difficulty in simultaneously imparting satisfactory low-temperature fixation properties and heat resistive preservability to the resulting toner. The PE generally has an acid value of 1–30, preferably 5–20. When the PE has an acid value, the resulting toner can be easily negatively charged.

The binder component (toner binder) in the toner of the present invention generally has a glass transition point (Tg) of 50–70° C., preferably 55–65° C. A glass transition point of less than 50° C. adversely affects the heat resistive preservability of the resulting toner, while too high a glass transition point of over 70° C. causes insufficient low-temperature fixation properties. Because of the presence of a urea-modified polyester or the like, the dry toner of the present invention has a low glass transition point but exhibits superior heat resistive preservability as compared with known polyester type toners. The temperature (TG') at which the storage elastic modulus of the toner binder as measured at a measuring frequency of 20 Hz is 10,000 dyne/cm$^2$ is generally 100° C. or higher, preferably 110 to 200° C. When the TG' is less than 100° C., the anti-hot offset properties of the resulting toner are adversely affected. The temperature (Tη) at which the viscosity of the toner binder as measured at a measuring frequency of 20 Hz is 1,000 poises is generally 180° C. or lower, preferably 90 to 160° C. When the Tη is over 180° C., the resulting toner has poor low-temperature fixation properties. Namely, in view of attaining both low-temperature fixation properties and anti-hot offset properties, the TG' of the toner binder is preferably higher than the Tη thereof. In other words, the difference between the TG' and the Tη (TG'−Tη) is preferably at least 0° C., more preferably at least 10°, most preferably at least 20° C. The upper limit of the difference is not specifically limited. In view of attaining both heat resistive preservability and low-temperature fixation properties, the difference between the Tη and the Tg is preferably 0 to 100° C., more preferably 10 to 90° C., most preferably 20 to 80° C.

As the colorant for use in the present invention, any pigments and dyes known to be used conventionally for the preparation of a toner can be used. Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG), Vulcan Fast Yellow (5G and R), Tartrazine Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone. These dyes and pigments can be used alone or in combination. The content of the colorant in the toner of the present invention is preferably about 1–15% by weight, more preferably 3–10% by weight, based on the weight of the toner.

In the present invention, the colorant may be used in the form of a master batch, which is a mixture of a colorant and a resin.

As a binder resin for preparation of the master batch or to be kneaded with the colorant, the above-described modified polyester or non-modified polyester may be used. Polymers that can be also used as the binder resin are homopolymers of styrene or substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene terpolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide polyvinyl butyral, polyacrylic acid resin, rosin, modified rosin, terpene resin, aliphatic or alicyclic hydrocarbon resin, aromatic petroleum resin, chlorinated paraffin, and paraffin wax. These polymers can be used alone or in combination.

The master batch can be obtained by mixing and kneading a binder resin and a colorant while applying a large shearing force thereto in a suitable kneader such as a three roll mill. At this time, an organic solvent may be used to enhance the interaction between the resin and the colorant. A method called "flushing" method can be adopted to obtain the master batch, in which an aqueous paste containing a colorant is kneaded together with a binder resin and an organic solvent until the colorant migrates to the resin and then the organic solvent and water are removed. This method is preferable because a wet cake of the colorant can be used without drying.

The toner of the present invention preferably contains a wax in addition to the toner binder and the colorant. Any wax may be suitably used for the purpose of the present invention. Preferred examples of the wax include polyolefin waxes such as polyethylene wax and polypropylene wax; long chain hydrocarbon waxes such as paraffin wax and sazole wax; and carbonyl group-containing waxes. Especially preferred is the use of a carbonyl group-containing wax. Illustrative of suitable carbonyl group-containing waxes are polyalkanoic acid esters such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol esters such as tristearyl trimellitate and distearyl maleate; polyalkanoic acid amides such as ethylenediamine dibehenyl amide; polyalkylamides such as trimellitic acid tristearyl amide; and dialkyl ketones such as distearyl ketone. Above all, the use of a polyalkanoic acid ester is preferred. The wax for use in the present invention generally has a melting point of 40–160° C., preferably 50–120° C., more preferably 60–90° C. A wax having a melting point of below 40° C. adversely affects the heat resistive preservability of the resulting toner, while a wax having a melting point of over 160° C. is apt to cause cold offset in fixation at a low temperature. Preferably, the wax has a melt viscosity of 5–1,000 cps, more preferably 10–100 cps, as measured at a temperature 20° C. higher than the melting point thereof. A wax having a melt viscosity of greater than 1,000 cps has little effect on improving the anti-hot offset properties and low-temperature fixation properties of a toner. The content of the wax in the toner is generally 1–40% by weight, preferably 3–30% by weight, based on the weight of the toner.

As a charge controlling agent for use in the toner of the present invention, any charge controlling agent generally used in the field of toners for use in electrophotography may be used. Illustrative of suitable charge controlling agents are Nigrosine dyes, triphenyl methane dyes, chromium-containing metal complex dyes, molybdic acid chelate pigments, rhodamine dyes, alkoxyamines, quaternary ammonium salts including fluorine-modified quaternary ammonium salts, alkylamide, phosphorus and phosphorus compounds, tungsten and tungsten compounds, fluorine-containing activators, metallic salts of salicylic acid and metallic salts of salicylic acid derivatives.

Specific examples of the charge controlling agents include Bontron 03 (Nigrosine dye), Bontron P-51 (quaternary ammonium salt), Bontron S-34 (metal-containing azo dye), E-82 (oxynaphthoic acid type metal complex), E-84 (salicylic acid type metal complex), and E-89 (phenol type condensation product), which are manufactured by Orient Chemical Industries Co., Ltd.; TP-302 and TP-415 (quaternary ammonium salt molybdenum complex), and TN-105 (zirconium compound), which are manufactured by Hodogaya Chemical Co., Ltd.; Copy Charge PSY VP2038 (quaternary ammonium salt), Copy Blue PR (triphenylmethane derivative), Copy Charge NEG VP2036 and Copy Charge NX VP434 (quaternary ammonium salt), which are manufactured by Hoechst AG; LPA-901 and LR-147 (boron complex), which are manufactured by Japan Carlit Co.; copper Phthalocyanine; perylene; quinacridone; azo pigments; and polymer compounds having a functional group such as a sulfonic group, a carboxyl group or a quaternary ammonium salt group. Preferably, a crystalline compound which can be easily crushed into fine particles with a particle size of 1 μm by stress or the like is used. The charge controlling agent particles may be added in advance in the resin particles containing a colorant to enhance the charging properties. The amount of the charge controlling agent particles to be agitated with the resin particles containing a colorant is preferably 0.01–2 parts by weight, more preferably 0.05–1 parts by weight, most preferably 0.1–0.5 parts by weight, per 100 parts by weight of the resin particles containing a colorant.

As a resin (a) for the resin fine particles for use in the present invention, any resin, whether a thermoplastic resin or a thermosetting resin, can be used as long as it can form an aqueous dispersion. Illustrative of the resins are vinyl type resin, polyurethane resin, epoxy resin, polyester resin, polyamide resin, polyimide resin, silicone resin, phenol resin, melamine resin, urea resin, aniline resin, ionomer resin and polycarbonate resin. These resins may be used alone or in combination. Above all, vinyl type resin, polyurethane resin, epoxy resin, polyester resin and combinations thereof are preferred since an aqueous dispersion of fine spherical resin particles can be easily obtained.

The vinyl type resin is a polymer obtained by homopolymerization or copolymerization of a vinyl type monomer, and preferred examples of the vinyl type monomer include the following (1) to (10).

(1) Vinyl hydrocarbons:

(1-1) Aliphatic vinyl hydrocarbons: alkenes such as ethylene, propylene, butene, isobutylene, pentane, heptene, diisobutylene, octene, dodecene, octadecene and α-olefins other than above; and alkadienes such as butadiene, isoprene, 1,4-pentadiene, 1,6-hexadiene, and 1,7-octadiene.

(1-2) Alicyclic vinyl hydrocarbons: mono- or di-cycloalkenes and alkadienes such as cyclohexene, (di)cyclopentadiene, vinylcyclohexene, ethylidene bicycloheptene; and terpenes such as pinene, limonene, and indene.

(1-3) Aromatic vinyl hydrocarbons: styrene and its hydrocarbyl (alkyl, cycloalkyl, aralkyl and/or alkenyl) substitutes such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzene; and vinylnaphthalene.

(2) Carboxyl group-containing vinyl monomers and their salts:

Unsaturated monocarboxylic acids having 3–30 carbon atoms, unsaturated dicarboxylic acids and their anhydrides and their monoalkyl esters (having 1–24 carbon atoms), and carboxyl group-containing vinyl monomers such as (meth) acrylic acid, maleic acid, maleic anhydride, monoalkyl maleate, fumaric acid, monoalkyl fumarate, crotonic caid, itaconic acid, monoalkyl itaconate, glycol monoether itaconate, citraconic acid, monoalkyl citraconate, and cinnamic acid.

(3) Sulfo group-containing vinyl monomer, vinyl group-containing monoesterified sulfonic acids and their salts: alkene sulfonic acids having 2–14 carbon atoms such as vinylsulfonic acid, (meth)allyl sulfonic acid, methylvinylsulfonic acid, styrene sulfonic acid; their alkyl derivatives having 2–24 carbon atoms such as α-methylstyrenesulfonic acid; sulfo(hydroxy)alkyl-(meth)acrylate or (meth)acrylamide such as sulfopropyl (meth)acrylate, 2-hydroxy-3-(meth) acryloxypropylsulfonic acid, 2-(meth)acryloylamino-2, 2-dimethylethanesulfonic acid, 2-(meth) acryloyloxyethanesulfonic acid, 3-(meth)acryloyloxy-2-hydroxypropanesulfonic acid, 2-(meth)acrylamide-2-methylpropanesulfonic acid, 3-(meth)acrylamide-2-hydroxypropanesulfonic acid, alkyl(having 3–18 carbon atoms)allylsulfosuccinic acid, sulfate of poly (n=2 to 30)oxyalkylene(ethylene, propylene, butylene: homopolymer, random copolymer, or block copolymer) mono(meth)acrylate such as poly(n=5 to 15)oxypropylene monomethacrylate sulfate, polyoxyethylene polycyclic phenyl ether sulfate, sulfates or sulfo group-containing monomer represented by the following general formulas (3-1) to (3-3); and their salts,

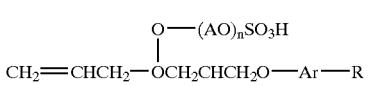

(3-1)

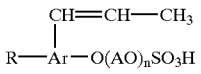

(3-2)

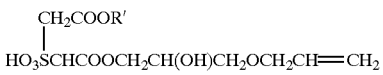

(3-3)

wherein R represents an alkyl group having 1–15 carbon atoms, A represents an alkylene group having 2–4 carbon atoms, Ar represents a benzene ring, n represents an integer between 1 and 50, and R' represents an alkyl group having 1–15 carbon atoms which may be substituted by a fluorine atom, and wherein when n is plural, each A may be the same or different, and when each A is different, they may be added either at random or in block.

(4) Phosphate group-containing vinyl monomers and their salts: (meth)acryloyloxyalkyl(C1–C24) monophosphate such as 2-hydroxyethyl (meth)acryloyl phosphate, phenyl-2-acryloyloxyethyl phosphate; (meth)acryloyloxyalkyl(having 1–24 carbon atoms) phosphonic acids such as 2-acryloyloxyethylphosphonic acid. Specific examples of the salts of the compounds (2) to (4) include alkali metal salts (sodium salts, potassium salts, etc.), alkaline earth metal salts (calcium salts, magnesium salts, etc.), ammonium salts, amine salts and quaternary ammonium salts.

(5) Hydroxyl group-containing vinyl monomers: hydroxystyrene, N-methylol (meth)acrylamide, hydroxyethyl (meth)acrylate, hydroxypropyl (meth) acrylate, polyethylene glycol mono(meth)acrylate, (meth)allyl alcohol, crotyl alcohol, isocrotyl alcohol, 1-butane-3-ol, 2-butane-1-ol, 2-butane-1,4-diol, propagyl alcohol, 2-hydroxyethyl propenyl ether, allyl ether of cane sugar and so on.

(6) Nitrogen-containing vinyl monomers:

(6-1) Amino group-containing vinyl monomers: aminoethyl (meth)acrylate, dimethylaminoethyl (meth) acrylate, diethyl-aminoethyl (meth)acrylate, t-butylaminoethyl methacrylate, N-aminoethyl (meth)acrylamide, (meth)acrylamine, morpholinoethyl (meth)acrylate, 4-vinylpyridine, 2-vinylpyridine, crotylamine, N,N-dimethylaminostyrene, methyl-α-acetaminoacrylate, vinylimidazol, N-vinylpyrrole, N-vinylthiopyrrolidone, N-arylphenylenediamine, aminocarbazole, aminothiazole, aminoindole, aminopyrrole, aminoimidazole, aminomercaptothiazole, and their salts.

(6-2) Amide group-containing vinyl monomers: (meth) acrylamide, N-methyl(meth)acrylamide, N-butylacrylamide, diacetoneacrylamide, N-methylol (meth)acrylamide, N,N'-methylene-bis-(meth) acrylamide, cinnamamide, N,N-dimethylacrylamide, N,N-dibenzylacrylamide, methacryl formamide, N-methyl-N-vinylacetoamide, N-vinylpyrrolidone and so on.

(6-3) Nitrile group-containing vinyl monomers: (meth) acrylonitrile, cyano styrene, cyanoacrylate and so on.

(6-4) Quaternary ammonium cation group-containing vinyl monomers: quaternized products (obtained using a quaternizing agent such as methyl chloride, dimethyl sulfate, benzyl chloride or dimethyl carbonate) of tertiary amino group-containing vinyl monomers such as dimethylaminoethyl (meth)acrylate, diethylaminoethyl (meth)acrylate, dimethylaminoethyl (meth)acrylamide, diethylaminoethyl (meth)acrylamide, and diallylamine.

(6-5) Nitro group-containing vinyl monomers: nitrostyrene and so on.

(7) Epoxy group-containing vinyl monomers: glycidyl (meth)acrylate, tetrahydrofurfuryl (meth)acrylate, p-vinylphenylphenyloxide and so on.

(8) Halogen-containing vinyl monomers: vinyl chloride, vinyl bromide, vinylidene chloride, acryl chloride, chlorostyrene, bromstyrene, dichlorostyrene, chloromethylstyrene, tetrafluorostyrene, chloroprene and so on.

(9) Vinyl esters, vinyl (thio)ethers, vinyl ketones, and vinyl sulfones:

(9-1) vinyl esters such as vinyl acetate, vinyl butyrate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxyacetate, vinyl benzoate, ethyl α-ethoxyacetate; alkyl (meth)acrylates having an alkyl group having 1–50 carbon atoms such as methyl (meth)acrylate, ethyl (meth)acrylate, propyl (meth)acrylate, butyl (meth)acrylate, 2-ethylhexyl (meth)acrylate, dodecyl (meth)acrylate, hexadecyl (meth)acrylate, heptadecyl (meth)acrylate, and eicosil (meth)acrylate; dialkyl fumarate (the two alkyl groups of which are straight, branched or alicyclic groups having 2–8 carbon atoms); dialkyl maleate (the two alkyl groups of which are straight, branched or alicyclic groups having 2–8 carbon atoms); poly(meth)allyloxyalkanes such as diallyloxyethane, triallyloxyethane, tetraallyloxy ethane, tetraallyloxy propane, tetraallyloxy butane and tetramethallyloxy ethane; vinyl monomes having a polyalkylene glycol chain such as polyethylene glycol (molecular weight: 300) mono(meth)acrylate, polypropylene glycol (molecular weight: 500) monoacrylate, methyl alcohol ethylene oxide (10 mole) adduct (meth) acrylate, and lauryl alcohol ethylene oxide (30 mole) adduct (meth)acrylate); poly(meth)acrylates such as poly(meth)acrylates of polyhydric alcohols, ethylene glycol di(meth)acrylate, propylene glycol di(meth) acrylate, neopentyl glycol di(meth)acrylate, trymethylolpropane tri(meth)acrylate, polyethylene glycol di(meth)acrylate; and so on.

(9-2) Vinyl (thio)ethers such as vinyl methyl ether, vinyl ethyl ether, vinyl propyl ether, vinyl butyl ether, vinyl 2-ethyl hexyl ether, vinyl phenyl ether, vinyl 2-methoxy ethyl ether, methoxybutadiene, vinyl 2-butoxy ethyl ether, 3,4-dihydro 1,2-pyran, 2-butoxy-2'-vinyloxy diethyl ether, vinyl 2-ethyl mercaptoethyl ether, acetoxystyrene, phenoxystyrene, and so on.

(9-3) Vinyl ketones such as vinyl methyl ketone, vinyl ethyl ketone and vinyl phenyl ketone; vinyl sulfones such as divinyl sulfide, p-vinyl diphenyl sulfide, vinyl ethyl sulfide, vinyl ethyl sulfone, divinyl sulfone and divinyl sulfoxide.

(10) Other vinyl monomers: isocyanatoethyl (meth) acrylate, m-isopropylpenyl-α,α-dimethylbenzyl isocyanate, and so on.

As copolymers of vinyl monomers, there are polymers obtained by copolymerization of two or more of above monomers at an arbitrary ratio, such as a styrene-(meth) acrylate copolymer, styrene-butadiene copolymer, (meth) acrylic acid-acrylate copolymer, styrene-acrylonitrile copolymer, styrene-maleic anhydride copolymer, styrene-(meth)acrylic acid ester copolymer, styrene-(meth)acrylic acid-divinyl benzene terpolymer, stylene-styrenesulfonic acid-(meth)acrylateic terpolymer.

The resin (a) must be able to form resin fine particles (A) in an aqueous dispersion, and thus should not be completely dissolved in water under conditions to form the aqueous dispersion. Thus, when the vinyl resin is a copolymer of a hydrophilic monomer and a hydrophobic monomer, the content of the hydrophobic monomer in the vinyl resin is preferably at least 10%, preferably at least 30%, although it depends on the type of the monomers. When the content of the hydrophobic monomer is less than 10%, the vinyl resin will be water-soluble and the size uniformity of the resulting toner particles is deteriorated. A hydrophilic monomer herein is a monomer which dissolves in water at an arbitrary rate and a hydrophobic monomer is a monomer which does not (a monomer which is not mixed with water).

The method of preparing an aqueous dispersion containing the resin (a) is not specifically limited. Specific examples of the method include the following (1) to (8).

(1) A method in which an aqueous dispersion of the resin fine particles (A) is directly prepared from a monomer as a starting material by a copolymerization reaction such as suspension polymerization, emulsion polymerization, seed polymerization or dispersion polymerization. This method is adopted when the resin (a) is a vinyl resin.

(2) A method in which a precursor (monomer, oligomer, etc.) or a solvent solution thereof is dispersed in an aqueous medium in the presence of a suitable dispersing agent and cured by heating or adding a curing agent. This method is adopted when the resin (a) is a polymerization type resin or a condensation type resin such as a polyester resin, polyurethane resin or epoxy resin.

(3) A method in which a suitable emulsifying agent is dissolved in a precursor (monomer, oligomer, etc.) or a solvent solution thereof (which is preferably a liquid but may be liquefied by heating) and water is added to the solution to cause phase-inversion emulsification of the precursor. This method is adopted when the resin (a) is a polymerization type resin or a condensation type resin such as a polyester resin, polyurethane resin or epoxy resin.

(4) A method in which resin particles obtained by pulverizing a resin prepared in advance by a polymerization reaction (by addition polymerization, ring-opening polymerization, polyaddition, addition condensation or condensation polymerization) with a mechanical or jet pulverizer and classifying the pulverized resin particles are dispersed in water in the presence of a suitable dispersing agent.

(5) A method in which resin particles obtained by spraying a solution of a resin prepared in advance by a polymerization reaction (by addition polymerization, ring-opening polymerization, polyaddition, addition condensation or condensation polymerization) dissolved in a solvent are dispersed in water in the presence of a suitable dispersing agent.

(6) A method in which a solvent is added to a solution of a resin prepared in advance by a polymerization reaction (by addition polymerization, ring-opening polymerization, polyaddition, addition condensation or condensation polymerization) dissolved in a solvent or a solution of a resin prepared as above dissolved in a solvent by heating is cooled to precipitate particles of the resin and the thus obtained resin particles are dispersed in water in the presence of a suitable dispersing agent.

(7) A method in which a solution of a resin prepared in advance by a polymerization reaction (by addition polymerization, ring-opening polymerization, polyaddition, addition condensation or condensation polymerization) dissolved in a solvent is dispersed in an aqueous medium in the presence of a suitable dispersing agent and the solvent is removed from the dispersion by heating or reducing the pressure.

(8) A method in which a suitable emulsifying agent is dissolved in a solution of a resin prepared in advance by a polymerization reaction (by addition polymerization, ring-opening polymerization, polyaddition, addition condensation or condensation polymerization) dissolved in a solvent and water is added to the solution to cause phase-inversion emulsification of the solution.

The resin fine particles (A) generally have a smaller particle size than the toner particles. In view of uniformity of particle size, the ratio of the volume average particle size of the resin fine particles (A) to the volume average particle size of the toner particles is preferably in the range of 0.001 to 0.3. When the particle size ratio is greater than 0.3, the resin fine particles (A) do not adhere to the surfaces of the toner particles efficiently and the resulting toner tends to have a wide particle size distribution.

The volume average particle size of the resin fine particles (A) can be adequately controlled within the above range to obtain a toner having a desired particle size. For example, when a toner having a volume average particle size of 5 μm is desired, the volume average particle size of the resin fine particles (A) is preferably controlled to fall in the range of 0.0025–1.5 pm, more preferably in the range of 0.005–1.0 μm. When a toner having a volume average particle size of 10 μm is desired, the volume average particle size of the resin fine particles (A) is preferably controlled to fall in the range of 0.005–3 μm, more preferably in a range of 0.05–2 μm. The volume average particle size can be measured with a laser particle size distribution meter, LA-920 (manufactured by HORIBA, Ltd.) or Multisizer II, manufactured by Coulter, Inc.

Inorganic fine particles may be suitably used, as an external additive, to improve the fluidity, developing efficiency and charging properties of the colored resin particles. Such inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle size of 5 mμ (5 nm) to 2 μm, more preferably 5 mμ to 500 mμ, and a BET specific surface area of 20–500 $m^2/g$. The inorganic fine particles are used in an amount of generally 0.01–5% by weight, preferably 0.01–2.0% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these external additives to a surface treatment to improve the hydrophobic properties thereof, deterioration of the fluidity and the charging properties of the toner can be avoided even under high humidity conditions. Suitable surface treating agents include silane coupling agents, silylating agents, silane coupling agents having a fluorinated alkyl group, organic titanate type coupling agents, aluminum type coupling agents, silicone oil and modified silicone oil.

A cleaning property improving agent may be also used in the toner of the present invention for facilitating the removal of toner remaining on a photoconductor or a primary transfer medium after transfer. Suitable examples of such a cleaning property improving agent include fatty acids and their metal salts such as stearic acid, zinc stearate and calcium stearate, and fine particles of a polymer prepared by, for example, soap-free emulsion polymerization such as polymethyl methacrylate fine particles and polystyrene fine particles. The particulate polymer preferably has a relatively has a relatively narrow particle size distribution, with a volume average particle size of 0.01–1 μm.

(Preparation Method)

A resin for the toner is prepared by the following method. A polyol (PO) and a polycarboxylic acid (PC) are reacted with each other in the presence of an esterification catalyst such as tetrabutoxytitanate or dibutyltin oxide at a temperature of 150–280° C. The reaction may be carried out under a reduced pressure while removing water produced in situ, if desired. The resulting hydroxyl group-containing polyester is reacted with a polyisocyanate (PIC) at 40–140° C. in the presence or absence of a solvent to obtain an isocyanate-containing prepolymer (A). The prepolymer (A) is reacted with amines (B) at 0–140° C. in the presence or absence of a solvent to obtain a urea-modified polyester. Any solvent inert to the polyisocyanate may be used. Suitable examples of the solvent include aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran. When a polyester (PE) not modified by a urea bond is used in conjunction, the polyester (PE) prepared by a similar method for preparing the hydroxyl group-containing polyester is dissolved and mixed into the urea-modified polyester solution after the reaction.

Dry toner can be prepared by the following method, although the present invention is not limited thereto.

(Melt-Kneading-Pulverizing Method)

First, ingredients of the toner such as a binder resin containing a urea-modified polyester resin, a charge controlling agent and a colorant are mechanically mixed with each other in a mixer such as a rotary blade mixer.

The thus obtained mixture is then kneaded in a kneader. A single or twin screw continuous kneader or a batch type roll mill may be suitably used as the kneader.

The kneading should be performed at a temperature near the softening point of the binder resin so as not to cause breakage of the molecular chain of the binder resin. Too low a temperature below the softening point will cause breakage of the molecular chain of the binder resin. The dispersion of the coloring agent, etc. in the binder resin will not sufficiently proceed when the temperature is excessively higher than the softening point.

The kneaded mixture is then solidified and the solidified mixture is ground, preferably in two, coarsely grinding and succeeding finely grinding stages. The earlier stage may be carried out by impinging the solidified mixture to an impact plate under a jet stream, while the later stage may be performed using a combination of a rotor and a stator with a small gap.

The ground mixture is classified in a jet flow utilizing tangential force to obtain a toner having an average size of, for example, 5–20 μm.

The thus obtained toner is, if desired, mixed with inorganic fine particles as an external additive such as hydrophobic silica fine particles to improve the fluidity, preservability, developing efficiency and transfer efficiency. The mixing with the external additive may be carried out using a conventional mixer preferably capable of controlling the mixing temperature. The external additive may be added gradually or at once. The rotational speed, mixing time and mixing temperature may be varied in any suitable manner. Illustrative of suitable mixers are a V-type mixer, rocking mixer, Ledige mixer, nauter mixer and Henschel mixer.

As methods to obtain spherical toner, there are a mechanical method in which ingredients of the toner such as a binder and a colorant are melt-kneaded, solidified, ground and further processed with a hybridizer or a mechanofusion; a spray dry method in which ingredients of the toner are dispersed in a solution of a toner binder dissolved in a solvent, the dispersion being subsequently spray dried; and a method in which ingredients of the toner are heated in an aqueous medium.

(Method for Preparing Toner in Aqueous Medium)

The aqueous medium for use in the present invention may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

The toner particles may be formed by reaction of a dispersion of the isocyanate-containing polyester prepolymer (A) with the amines (B) in an aqueous medium or from a urea-modified polyester or the like prepared in advance. A dispersion of a urea-modified polyester or the prepolymer (A) can be stably formed in an aqueous medium by a method in which a composition of toner ingredients including a urea-modified polyester or the prepolymer (A) is added to an aqueous medium and a share force is applied thereto.

It is preferred that the prepolymer (A) and the other toner ingredients, such as a colorant, a colorant master batch, a releasing agent, a charge controlling agent and a non-modified polyester be mixed in advance before being dispersed in an aqueous medium rather than being mixed in the aqueous medium at the time of the formation of the dispersion. In the present invention, the other toner ingredients, such as a colorant, a releasing agent and a charge controlling agent, may be added to the aqueous medium after the formation of the toner particles. For example, the colorant may be incorporated into the toner by a known method after the formation of the toner particles without a colorant.

Dispersion into the aqueous medium may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2–20 $\mu$m in a facilitated manner. The high speed shearing type dispersing device is generally operated at a revolution speed of 1,000–30,000 rpm, preferably 5,000–20,000 rpm. The dispersing time is generally 0.1 to 5 minutes in the case of a batch type dispersing device. The dispersing step is generally performed at 0–150° C. (under a pressurized condition), preferably 40–98° C. A higher temperature is suitably used to decrease the viscosity of the mass and facilitate the dispersion.

The aqueous medium is generally used in an amount of 50–2,000 parts by weight, preferably 100–1,000 parts by weight per 100 parts by weight of the toner composition containing the urea-modified polyester or the prepolymer (A) and other ingredients for reasons of obtaining toner particles with desired particle size efficiently. A dispersing agent is preferably be to stabilize the dispersion and to obtain sharp particle size distribution.

The synthesis of a urea-modified polyester or the like from the prepolymer (A) may be carried out by a method in which polyvalent compounds such as the amines (B) or polyisocyanate are added to the aqueous medium prior to the dispersion of the toner ingredients into an aqueous medium to cause a reaction or a method in which the polyvalent compounds such as the amines (B) or polyisocyanate are added to the aqueous medium after the dispersion of the toner ingredients into an aqueous medium to cause a reaction at the particle interfaces. By the latter method, the urea-modified polyester or the like is generated on the surfaces of the resulting toner particles, so that a concentration gradient can be established in the toner particles.

Illustrative of dispersing agents used to emulsify and disperse an oil phase in which the toner ingredients are dispersed into a water-containing liquid include anionic surfactants such as alkylbenzenesulfonate, α-olefin sulfonate, and phosphate; cationic surfactants such as amine salt surfactants, e.g. an alkylamine salt, aminoalcohol fatty acid derivatives, polyamine fatty acid derivatives and imidazoline; and quaternary ammonium salt surfactants, e.g. alkyl trimethylammonium salt, dialkyl dimethylammonium salt, alkyl dimethylbenzylammonium salt, pyridinium salt, alkyl isoquinolinium salt and benzethonium chloride; non-ionic surfactants such as fatty acid amide derivatives and polyhydric alcohol derivatives; and ampholytic surfactants such as alanine, dodecyl di(aminoethyl)glycine, di(octylaminoethyl)glycine and N-alkyl-N,N-dimethylammonium betaine.

A surfactant having a fluoroalkyl group can exert its effects in a very small amount. Suitable anionic surfactants having a fluoroalkyl group include fluoroalkylcarboxylic acids having 2–10 carbon atoms and their metal salts, disodium perfluorooctanesulfonylglutamate, sodium 3-[omega-fluoroalkyl($C_6$–$C_{11}$)oxy]-1-alkyl($C_3$–$C_4$) sulfonate, sodium 3-[omega-fluoroalkanoyl($C_6$–$C_8$)-N-ethylamino]-1-propanesulfonate, fluoroalkyl($C_{11}$–$C_{20}$) carboxylic acids and their metal salts, perfluoroalkylcarboxylic acids ($C_7$–$C_{13}$) and their metal salts, perfluoroalkyl($C_4$–$C_{12}$)sulfonic acids and their metal salts, perfluorooctanesulfonic acid diethanolamide, N-propyl-N-(2-hydroxyethyl)perfluorooctanesulfonamide, perfluoroalkyl($C_6$–$C_{10}$)sulfoneamidopropyl trimethylammonium salts, perfluoroalkyl ($C_6$–$C_{10}$)-N-ethylsulfonylglycine salts, and monoperfluoroalkyl($C_6$–$C_{16}$) ethylphosphoates.

Examples of tradenames of anionic surfactants having a fluoroalkyl group include Surflon S-111, S-112 and S-113 (manufactured by Asahi Glass Co., Ltd.), Florard FC-93, FC-95, FC-98 and FC-129 (manufactured by Sumitomo 3M Ltd.), Unidine DS-101 and DS-102 (manufactured by Daikin Industries Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos Co., Ltd.).

Examples of suitable cationic surfactants having a fluoroalkyl group include primary, secondary or tertiary aliphatic amine acids; aliphatic quaternary ammonium salts such as perfluoroalkyl($C_6$–$C_{10}$) sulfonamidopropyltrimethyl-ammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Industries Ltd.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

In addition, dispersing agents of inorganic compounds, which are hardly soluble in water, such as tricalcium phosphate, calcium carbonate, titanium oxide, colloidal silica, and hydroxyapatite can also be used.

A polymeric protective colloid may be used to stabilize the dispersed droplets. Specific examples of the polymeric protective colloid include acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide; vinyl alcohol and ethers thereof such as vinylmethyl ether, vinylethyl ether and vinylpropyl ether; esters of vinyl alcohol with carboxyl group-containing compounds such as vinyl acetate, vinyl propionate, and vinyl butyrate; acrylamide, methacrylamide, diacetone acrylamide, and methylol compounds thereof; acid chlorides such as acrylic acid chloride, and methacrylic acid chloride; nitrogen-containing or heterocyclic homopolymers and copolymers such as vinyl pyridine, vinyl pyrrolidone, vinyl imidazole, and ethyleneimine; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

When a dispersing agent capable of being dissolved in an acid or an alkali is used, washing with an acid or alkali and then with water can remove the dispersing agent from the toner particles. For example, calcium phosphate may be removed by washing with an acid and then with water. An enzyme can be also used to remove certain kinds of dispersing agent. The dispersing agent, which may remain on the toner particles, is preferably removed by washing after the extension reaction and/or the crosslinking reaction in view of the charging characteristics of the toner.

In addition, a solvent capable of dissolving the urea-modified polyester and the prepolymer (A) is preferably used to lower the viscosity of the toner composition. The use of such a solvent can produce toner particles having a narrow particle size distribution. A volatile solvent having a boiling point of lower than 100° C. is preferred since it is easy to remove. Examples of the solvent include toluene, xylene benzene, carbon tetrachloride, methylene chloride, 1,2-dichloroethane, 1,1,2-trichloroethane, trichloroethylene, chloroform, monochlorobenzene, dichlorloethylidene, methyl acetate, ethyl acetate, methyl ethyl ketone, and methyl isobutyl ketone. These solvents may be used alone or in combination. Especially preferred is the use of an aromatic solvent such as toluene or xylene, or a halogenated hydrocarbon such as methylene chloride, 1,2-dichloroethane, chloroform or carbon tetrachloride. The solvent is generally used in an amount of 0–300 parts by weight, preferably 0–100 parts by weight, more preferably 25–70 parts by weight, per 100 parts by weight of the prepolymer (A). The solvent is removed by heating under ambient or a reduced pressure after the extension reaction and/or the crosslinking reaction.

The extension and/or crosslinking reaction time is generally 10 minutes to 40 hours, preferably 2–24 hours, although it depends on the reactivity of the functional groups in the prepolymer (A) such as isocyanate group and the polyvalent compounds such as the amines (B). The reaction temperature is generally 0–150° C., preferably 40–98° C. When desired, a known catalyst such as dibutyltin laurate or dioctyltin laurate may be used.

As a chain extender or a crosslinking agent, a polyvalent compound having two or more functional groups capable of reacting with the reactive prepolymer such as the prepolymer (A).

The removal of the organic solvent from the resulting emulsified dispersion can be carried out by gradually heating the dispersion to evaporate the organic solvent. Alternatively, the dispersion is sprayed into a dry atmosphere to evaporate the organic solvent and the aqueous dispersing agent to obtain fine toner particles. The dry atmosphere into which the dispersion is sprayed may be a gas, such as air, nitrogen, carbon dioxide, combustion gas, heated above the boiling point of the organic solvent having the highest boiling point in the solvents used. A short-time treatment with a spray drier, a belt drier or a rotary kiln can provide toner particles with desired quality.

When the toner particles in the dispersion obtained have a wide particle size distribution, classification may be conducted. The classification for the removal of excessively fine particles is preferably carried out before separation of the toner particles from the dispersion for reasons of efficiency, although the classification may be preceded by the separation and drying of the particles. Classification for the removal of fine particles may be performed using, for example, a cyclone, a decanter or a centrifugal device. Unnecessary large and small particles thus separated may be reused as raw materials for the preparation of toner particles. At this time, the large and small particles may be wet.

The dispersing agent used is preferably removed as much as possible, preferably simultaneously with the classification.

The thus obtained toner particles are mixed with different types of particles such as a particulate releasing agent, a particulate charge controlling agent, a particulate fluidizing agent and a particulate colorant. By applying a mechanical force to the mixture, these particles can be fixed and unified with the surfaces of the toner particles and prevented from separating from the resulting composite particles.

Specific methods useful for applying mechanical force include impacting the mixture rapidly-rotating blades; and discharging the mixture into a high speed airflow so that the particles of the mixture accelerate and collide with each other or the particles impact against a proper plate or some such object. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

(Carrier for Two-component Developer)

The toner of the present invention can be used as a two-component developer after mixed with a magnetic carrier. The content of the toner in the developer is preferably 1–10 parts by weight per 100 parts by weight of the carrier. Any conventionally-known magnetic carrier, such as iron powder, ferrite powder, magnetite powder, magnetic resin carrier, can be used. Illustrative of resins for covering the surface of the carrier include amino resin, urea-formaldehyde resin, melamine resin, benzoguanamine resin, urea resin, polyamide resin and epoxy resin. Also usable for covering a carrier are polyvinyl or polyvinylidene resins; polystyrene resins such as acrylic resin, polymethyl methacrylate resin, polyacrylonitrile resin, polyvinyl acetate resin, polyvinyl alcohol resin, polyvinyl butyral resin, polystyrene resin and styrene-acrylic copolymer; halogenated olefin resins such as polyvinyl chloride resin; polyester resins such as polyethylene terephthalate resin and polybutylene terephthalate resin; polycarbonate resins; polyethylene resins; polyvinyl fluoride resins; polyvinylidene fluoride resins; polytrifluoroethylene resins; polyhesafluoropropylene resins; copolymers of vinylidene fluoride and an acrylic monomer; copolymers of vinylidene fluoride and vinyl fluoride; terpolymers of tetrafluoroethylene, vinylidene fluoride and a fluorine-free monomer; and silicone resins. The resin coating for the carrier may contain conductive powder such as metal powder, carbon black, titanium oxide, tin oxide or zinc oxide. The conductive powder preferably has an average particle size of 1 μm or less for reasons of easy control of the electric resistance. The toner of the present invention may be used as a one-component magnetic or nonmagnetic toner requiring no carrier.

EXAMPLES

The following examples will further illustrate the present invention. Parts are by weight.

Preparation Example of Comparative Toners 1a, 1b and 1c

<Synthesis of Low-molecular Weight Polyester>

220 Parts of an ethylene oxide (2 mole) adduct of bisphenol A, 561 parts of a propylene oxide (3 mole) adduct of bisphenol A, 218 parts of terephthalic acid, 48 parts of adipic acid and 2 parts of dibutyltin oxide were charged in a reaction vessel equipped with a condenser, a stirrer and a nitrogen gas feed pipe, and reacted at 230° C. under ambient pressure for 8 hours. The reaction was further continued for 5 hours at a reduced pressure of 10–15 mmHg. 45 Parts of trimellitic anhydride was added to the reaction vessel and the mixture was reacted at 180° C. under ambient pressure for 2 hours, thereby obtaining a low-molecular weight polyester 1 having a number average molecular weight of 2500, a weight average molecular weight of 6700, a Tg of 43° C. and an acid value of 25.

<Preparation of Master Batch>

1200 Parts of water, 540 parts of carbon black (Printex 35, made by Degussa Co., DBP oil absorption: 42 ml/100 mg, pH: 9.5), and 1200 parts of the low-molecular weight polyester 1 resin were mixed in a Henschel mixer (manufactured by Mitsui Mining Company, Limited). The mixture was kneaded in a double roll kneader at 150° C. for 30 minutes. The kneaded mixture was rolled and cooled, and then pulverized with a pulverizer, thereby obtaining a master batch 1.

<Preparation of Oil Phase>

378 Parts of the low-molecular weight polyester 1, 110 parts of carnauba wax, 22 parts of CCA (salicylic acid metal complex, E-84, made by Orient Chemical Industries, Ltd.) and 947 parts of ethyl acetate were charged in a vessel equipped with a stirrer and a thermometer and heated to 80° C. with stirring. The mixture was maintained at 80° C. for 5 hours and then cooled to 30° C. in one hour. 500 Parts of the master batch 1 and 500 parts of ethyl acetate were added to the vessel and mixed for 1 hours, thereby obtaining an ingredient solution 1.

1324 Parts of the ingredient solution 1 were charged in a vessel and dispersion of the carbon black and the wax was performed by passing the solution through a beads mill (Ultraviscomill, manufactured by Aimex Co., Ltd.) filled with zirconia beads having a diameter of 0.5 mm by 80 vol. % three times under conditions of a liquid feeding rate of 1 kg/hr and a disk circumferential velocity of 6 m/sec. This was then mixed with 1324 parts of a 65% ethyl acetate solution of the low-molecular weight polyester 1. The mixture was once passed through the beads mill under the same conditions as above, thereby obtaining a pigment-wax dispersion 1 having a solid concentration of 50% (130° C., 30 minutes).

<Preparation of Aqueous Phase>

1 Part of a polyvinyl alcohol (PVA-235, made by KURARAY Co., Ltd.) was dissolved in 100 parts of water. This was designated as "aqueous phase 1".

<Emulsification-Removal of Solvent>

648 Parts of the pigment-wax dispersion 1 and 154 parts of the low-molecular weight polyester 1 were charged in a vessel and mixed with TK Homomixer (manufactured by Tokushu Kika Kogyo Co., Ltd.) at 5,000 rpm for one minute. The mixture was then mixed with 1,200 parts of the aqueous phase 1 with TK Homomixer at 13,000 rpm for 20 minutes, thereby obtaining an emulsified slurry 1.

The thus obtained emulsified sully 1 was heated at 30° C. for 8 hours and then aged at 45° C. for 4 hours in a vessel equipped with a stirrer and a thermometer to remove the solvent, thereby obtaining a dispersed slurry 1 having a volume median particle size of 6.2 μm and a number median particle size of 5.0 μm (measured with Multisizer II).

<Washing-Drying>

100 Parts of the dispersed slurry 1 was filtered under a reduced pressure.

(1) The filter cake and 100 parts of ion-exchanged water were mixed with TK Homomixer (at 12,000 rpm for 10 minutes), and the mixture was filtered.

(2) The filter cake obtained in (1) and 100 parts of ion-exchanged water were mixed with TK Homomixer (at 12,000 rpm for 30 minutes), and the mixture was filtered under a reduced pressure.

(3) The filter cake obtained in (2) and 100 parts of ion-exchanged water were mixed with TK Homomixer (at 12,000 rpm for 10 minutes), and the mixture was filtered.

(4) The filter cake obtained in (3) was divided into three. These were subjected to the process of being mixed with 300 parts of ion-exchanged water with TK Homomixer (at 12,000 rpm for 10 minutes) and then filtered once, twice and three times, respectively, thereby obtaining a filter cakes 1a, 1b and 1c.

The filter cakes 1a, 1b and 1c were dried at 45° C. for 48 hours in a circulating air drier and then sieved with a 75 μm mesh sieve, thereby obtaining mother toners 1a, 1b and 1c. 100 Parts of mother toners 1a, 1b and 1c were respectively mixed with 0.7 parts of hydrophobic silica and 0.3 parts of hydrophobized titanium oxide in a Henschel mixer, thereby obtaining Toners 1a, 1b and 1c.

Preparation Example of Toner 1 of the Present Invention

A Toner 1 of the present invention was obtained in the same manner as that of the Comparative Toner 1a except that the washing-drying process was performed as follows.

(Washing-Drying)

100 Parts of the dispersed slurry 1 was filtered under a reduced pressure.

(1) The filter cake and 100 parts of ion-exchanged water were mixed with TK Homomixer (at 12,000 rpm for 10 minutes), and the mixture was filtered.

(2) The filter cake obtained in (1) and 100 parts of ion-exchanged water were mixed with TK Homomixer (at 12,000 rpm for 30 minutes), and the mixture was filtered under a reduced pressure.

(3) The filter cake obtained in (2) and 100 parts of ion-exchanged water were mixed with TK Homomixer (at 12,000 rpm for 10 minutes), and the mixture was filtered.

(4) The filter cake obtained in (3) and 300 parts of ion-exchanged water were mixed with TK Homomixer (at 12,000 rpm for 10 minutes), and the mixture was filtered. The same process was repeated four more times, thereby obtaining a filter cake 1.

The filter cake 1 was dried at 45° C. for 48 hours in a circulating air drier and then sieved with a 75 μm mesh sieve, thereby obtaining a mother toner 1. 100 Parts of the mother toner 1 were mixed with 0.7 parts of hydrophobic silica and 0.3 parts of hydrophobized titanium oxide in a Henschel mixer, thereby obtaining Toner 1.

Preparation Example of Toner 2 of the Present Invention

<Synthesis of Solid Dispersion (Organic Fine Particle Emulsion)>

683 Parts of water, 11 parts of a sodium salt of sulfuric acid ester of ethylene oxide adduct of methacrylic acid (Eleminol RS-30, made by Sanyo Chemical Industries), 138 parts of styrene, 138 parts of methacrylic acid, 1 parts of ammonium persulfate were charged in a reaction vessel equipped with a stirrer and a thermometer and stirred at 400 rpm for 15 minutes to obtain a white emulsion. The emulsion was reacted to 75° C. and reacted for 5 hours. This was mixed with 30 parts of a 1% aqueous solution of ammonium persulfate, and the mixture was aged at 75° C. for 5 hours, thereby obtaining an aqueous dispersion (fine particle dispersion 1) of a vinyl resin (copolymer of styrene-methacrylic acid-sodium salt of sulfuric acid ester of ethylene oxide adduct of methacrylic acid). The fine particle dispersion 1 had a volume average particle size of 0.14 μm when measured with LA-920. Part of the fine particle dispersion 1 was dried to isolate the resin component. The Tg of the resin component was 152° C.

<Preparation of Aqueous Phase>

990 Parts of water, 83 parts of the fine particle dispersion 1, 37 parts of a 48.5% aqueous solution of sodium dodecyldiphenyl ether disulfonate (Eleminol MON-7, made by Sanyo Chemical Industries) and 90 parts of ethyl acetate were mixed and stirred to obtain a milky white liquid, which was designated as "aqueous phase 2".

<Emulsification-Removal of Solvent>

648 Parts of the pigment-wax dispersion 1, 154 parts of the low-molecular weight polyester 1 were charged in a vessel and mixed with TK Homomixer (manufactured by Tokushu Kika Kogyo Co., Ltd.) at 5,000 rpm for one minute. 1,200 Parts of the aqueous phase 2 were added to the vessel and mixed with TK Homomixer at 13,000 rpm for 20 minutes, thereby obtaining an emulsified slurry 2.

The thus obtained emulsified slurry 2 was charged in a vessel equipped with a stirrer and a thermometer. A 10% aqueous solution of sodium hydroxide was added to the emulsified slurry 2 until the pH reached 11. The mixture was heated at 30° C. for 8 hours to remove the solvent and then aged at 45° C. for 4 hours, thereby obtaining a dispersed slurry 2 having a volume median particle size of 5.8 μm and a number median particle size of 5.0 μm (measured with Multisizer II).

<Washing-Drying>

100 Parts of the dispersed slurry 2 was filtered under a reduced pressure.

(1) The filter cake and 100 parts of ion-exchanged water were mixed with TK Homomixer (at 12,000 rpm for 10 minutes), and the mixture was filtered.

(2) The filter cake obtained in (1) and 100 parts of ion-exchanged water were mixed with TK Homomixer (at 12,000 rpm for 30 minutes) and the mixture was filtered under a reduced pressure.

(3) The filter cake obtained in (2) and 100 parts of ion-exchanged water were mixed with TK Homomixer (at 12,000 rpm for 10 minutes), and the mixture was filtered.

(4) The filter cake obtained in (3) and 300 parts of ion-exchanged water were mixed with TK homomixer (at 12,000 rpm for 10 minutes), and the mixture was filtered. The same process was repeated once again, thereby obtaining a filter cake 2.

The filter cake 2 was dried at 45° C. for 48 hours in a circulating air drier and then sieved with a 75 μm mesh sieve, thereby obtaining a mother toner 2. 100 Parts of the mother toner 2 were mixed with 0.7 parts of hydrophobic silica and 0.3 parts of hydrophobized titanium oxide in a Henschel mixer, thereby obtaining Toner 2 of the present invention.

Preparation Example of Toner 3 of the Present Invention

<Synthesis of Intermediate Polyester>

682 Parts of ethylene oxide (2 mole) adduct of bisphenol A, 81 parts of propylene oxide (2 mole) adduct of bisphenol A, 283 parts of terephthalic acid, 22 parts of trimellitic anhydride and 2 parts of dibutyltin oxide were charged in a reaction vessel equipped with a condenser, a stirrer and a nitrogen gas feed pipe and reacted at 230° C. under ambient pressure for 8 hours. The reaction was further continued under a reduced pressure of 10 to 15 mmHg for 5 hours to obtain an intermediate polyester 1 having a number average molecular weight of 2100, a weight average molecular weight of 9500, a Tg of 55° C., an acid value of 0.5 and a hydroxyl value of 49.

411 Parts of the intermediate polyester 1, 89 parts of isophorone diisocyanate and 500 parts of ethyl acetate were charged in a reaction vessel equipped with a condenser, a stirrer and a nitrogen gas feed pipe and reacted at 100° C. for 5 hours to obtain a prepolymer 1 having a free isocyanate content of 1.53% by weight.

<Synthesis of Ketimine>

170 Parts of isophorone diamine and 75 parts of methyl ethyl ketone were charged in a reaction vessel equipped with a stirrer and a thermometer and reacted at 50° C. for 5 hours to obtain a ketimine compound 1 having an amine value of 418.

<Emulsification-Removal of Solvent>

648 Parts of the pigment-wax dispersion 1, 154 parts of the prepolymer 1 and 6.6 parts of the ketimine compound 1 were charged in a vessel and mixed with TK Homomixer (manufactured by Tokushu Kika Kogyo Co., Ltd.) at 5,000 rpm for 1 minute. 1,200 Parts of the aqueous phase 1 were added to the vessel and mixed with TK Homomixer at 13,000 rpm for 20 minutes, thereby obtaining an emulsified slurry 3.

The thus obtained emulsified sully 3 was charged in a vessel equipped with a stirrer and a thermometer. A 10% aqueous solution of sodium hydroxide was added to the emulsified slurry 3 until the pH reached 11. The mixture was heated at 30° C. for 8 hours to remove the solvent and then aged at 45° C. for 4 hours, thereby obtaining a dispersed slurry 3 having a volume median particle size of 5.9 μm and a number median particle size of 5.1 μm (measured with Multisizer II).

<Washing-Drying>

100 Parts of the dispersed slurry 3 was filtered under a reduced pressure.

(1) The filter cake and 100 parts of ion-exchanged water were mixed with TK Homomixer (at 12,000 rpm for 10 minutes), and the mixture was filtered.

(2) The filter cake obtained in (1) and 100 parts of a 10% aqueous solution of sodium hydroxide were mixed with TK Homomixer (at 12,000 rpm for 30 minutes), and the mixture was filtered under a reduced pressure.

(3) The filter cake obtained in (2) and 100 parts of a 10% hydrochloric acid were mixed with TK Homomixer (at 12,000 rpm for 10 minutes), and the mixture was filtered.

(4) The filter cake obtained in (3) and 300 parts of ion-exchanged water were mixed with TK Homomixer (at 12,000 rpm for 10 minutes), and the mixture was filtered. The same process was repeated once again, thereby obtaining a filter cake 3.

The filter cake 3 was dried at 45° C. for 48 hours in a circulating air drier and then sieved with a 75 μm mesh sieve, thereby obtaining a mother toner 3. 100 Parts of the mother toner 3 were mixed with 0.7 parts of hydrophobic silica and 0.3 parts of hydrophobized titanium oxide in a Henschel mixer, thereby obtaining Toner 3 of the present invention.

Preparation Example of Toner 4 of the Present Invention

A mother toner 1 was obtained in the same manner as in the preparation of the toner 1. 100 Parts of the mother toner were mixed with 0.8 parts of a charge controlling agent (salicylic acid metal complex, E-84, made by Orient Chemical Industries, Ltd.) in Q mixer (manufactured by Mitsui Mining Company, Limited), thereby obtaining a charge controlling agent-containing toner. 100 Parts of the charge controlling agent-containing toner were mixed with 0.7 parts of hydrophobic silica and 0.3 parts of hydrophobized titanium oxide in a Henschel mixer, thereby obtaining Toner 4 of the present invention.

Preparation Example of Comparative Toners 2 to 5

Comparative Toners 2, 3, 4 and 5 were prepared in the same manner as in the preparation of the comparative toner 1c except that the following master batches were used.

<Preparation Example of Comparative Toner 2>

| | |
|---|---|
| Water | 1200 parts |
| Water containing cake of Phthalocyanine Green (solid content: 30%) | 200 parts |
| Carbon black (MA60, made by Mitsubishi Chemical Corporation) | 540 parts |

The above ingredients were well stirred with a flasher. The mixture was kneaded with 1200 parts of a polyester resin (acid value: 3, hydroxyl value: 25, Mn: 45,000, Mw/Mn: 4.0, Tg: 60° C.) at 150° C. for 30 minutes. The kneading was continued for 1 hour after addition of 1,000 parts of xylene. Then, water and xylene were removed from the kneaded mixture. The mixture was rolled and cooled, and pulverized with a pulvelizer, thereby obtaining a master batch 2. A comparative toner 2 was prepared using 175 parts of the thus obtained master batch in the same manner as in the preparation of Comparative Toner 1.

<Preparation Example of Comparative Toner 3>

| | |
|---|---|
| Water | 600 parts |
| Water containing cake of Pigment Yellow 17 (solid content: 50%) | 1200 parts |

The above ingredients were well stirred with a flasher. The mixture was kneaded with 1200 parts of a polyester resin (acid value: 3, hydroxyl value: 25, Mn: 45,000, Mw/Mn: 4.0, Tg: 60° C.) at 150° C. for 30 minutes. The kneading was continued for 1 hour after addition of 1,000 parts of xylene. Then, water and xylene were removed from the kneaded mixture. The mixture was rolled and cooled, and pulverized with a pulvelizer. The pulverized mixture was passed through a three roll mill twice, thereby obtaining a master batch 3. Comparative Toner 3 was prepared using 200 parts of the thus obtained master batch in the same manner as in the preparation of Comparative Toner 1.

<Preparation Example of Comparative Toner 4>

| | |
|---|---|
| Water | 600 parts |
| Water containing cake of Pigment Red 57 (solid content: 50%) | 1200 parts |

The above ingredients were well stirred with a flasher. The mixture was kneaded with 1200 parts of a polyester resin (acid value: 3, hydroxyl value: 25, Mn: 45,000, Mw/Mn: 4.0, Tg: 60° C.) at 150° C. for 30 minutes. The kneading was continued for 1 hour after addition of 1,000 parts of xylene. Then, water and xylene were removed from the kneaded mixture. The mixture was rolled and cooled, and pulverized with a pulvelizer. The pulverized mixture was passed through a three roll mill twice, thereby obtaining a master batch 4. Comparative Toner 4 was prepared using 175 parts of the thus obtained master batch in the same manner as in the preparation of Comparative Toner 1.

<Preparation Example of Comparative Toner 5>

| | |
|---|---|
| Water | 600 parts |
| Water containing cake of Pigment Blue 15:3 (solid content: 50%) | 1200 parts |

The above ingredients were well stirred with a flasher. The mixture was kneaded with 1200 parts of a polyester resin (acid value: 3, hydroxyl value: 25, Mn: 45,000, Mw/Mn: 4.0, Tg: 60° C.) at 150° C. for 30 minutes. The kneading was continued for 1 hour after addition of 1,000 parts of xylene. Then, water and xylene were removed from the kneaded mixture. The mixture was rolled and cooled, and pulverized with a pulvelizer. The pulverized mixture was passed through a three roll mill twice, thereby obtaining a master batch 5. Comparative Toner 5 was prepared using 140 parts of the thus obtained master batch in the same manner as in the preparation of Comparative Toner 1.

Preparation Example of Toners 5 to 8 of the Present Invention

Toners 5 to 8 of the present invention were prepared in the same manner as in the preparation of the toner 1 except that the master batches 2 to 5 were used in place of the master batch in the same amount used in the preparation of Comparative Toners 2 to 5.

A developer comprising 5% by weight of the toner mixed with an external additive and 95% by weight of copper-zinc ferrite carrier coated with a silicone resin and having an average particle size of 40 μm is prepared. Continuous printing was conducted using a copying machine which is capable of printing 45 A4 sheets per minute, imagio NEO 450, manufactured by Ricoh Company, Ltd., and a copying machine which is capable of printing 28 A4 sheets in full color per minute, Aficio AP3800C, manufactured by Ricoh Company, Ltd., and evaluation was made according to the following criteria. The results are summarized in Tables 1 and 2. Also, modified versions of the above copying machines, in which a heater was provided in the photoconductor so that the surface temperature of the photoconductor can be maintained at 50° C., were prepared and comparative experiments were conducted.

(a) Fixation Properties

The copying machines were adjusted such that 1.0±0.1 mg/cm$^2$ of toner was developed in a solid image (a four color superimposed image, in the case of full color) on a transfer sheet (Type 6200, made by Ricoh Company, Ltd.) and the temperature of the fixing roller and belt was variable, and the temperature up to which offset did not occur was measured. The temperature of the fixing roller and belt at which an image which was able to provide a residual rate of image density of at least 70% when rubbed with a fiber pad was obtained was defined as the fixing lower limit temperature. The temperature at which offset occurred was defined as the offset temperature. The difference between the offset temperature and the fixing lower limit temperature is referred to as fixable range. As the fixable range is larger, the toner has a larger margin in fixation properties and can constantly provide good images without being affected by temperature variation of fixing members.

(b) Image Blur

Printing of 150,000 copies of a chart having an image area of 6% was made under conditions of a temperature of 30° C. and a humidity of 90%, and the print state between dots of the 150,000th image was compared with that of a print scale sample to evaluate the effect of voids of dots and blur on image reproducibility on a 1 to 5 scale. The larger the number is, the higher the reproducibility is. A score of 4 or higher is acceptable.

(c) Environmental Fluctuation Rate

The charging quantity of the developer after producing 150,000 of copies of a chart having an image area of 6% under conditions of a temperature of 30° C. and a humidity of 90% was measured with a blow-off device. Also, the charging quantity of the developer under conditions of a temperature of 10° C. and a humidity of 15% was measured. The value obtained by dividing the difference of the absolute values of the charging quantities by the average thereof was defined as the environmental fluctuation rate of the toner. The smaller the value is, the toner can be expected to provide stable reproducibility irrespective of environmental conditions.

For example, when the charging quantities are −10 $\mu$C/g and −5 $\mu$C/g, the environmental fluctuation rate is (10−5)/7.5×100=67%.

TABLE 1

| Example No. | Toner | $(W_{100} - W_0)/W_{100}$ | Copying machine | Photo-conductor |
|---|---|---|---|---|
| Comp. Ex. 1a | Comp. Toner 1a | 0.45 | imagio Neo 450 | Not heated |
| Comp. Ex. 1b | Comp. Toner 1b | 0.38 | imagio Neo 450 | Not heated |
| Comp. Ex. 1c | Comp. Toner 1c | 0.33 | imagio Neo 450 | Not heated |
| Ex. 1 | Toner 1 | 0.26 | imagio Neo 450 | Not heated |
| Ex. 2 | Toner 2 | 0.15 | imagio Neo 450 | Not heated |
| Ex. 3 | Toner 3 | 0.1 | imagio Neo 450 | Not heated |
| Ex. 4 | Toner 4 | 0.05 | imagio Neo 450 | Not heated |
| Comp. Ex. 2a | Comp. Toner 1a | 0.45 | imagio Neo 450 modified version | Heated |
| Comp. Ex. 2b | Comp. Toner 1b | 0.38 | imagio Neo 450 modified version | Heated |
| Comp. Ex. 2c | Comp. Toner 1c | 0.33 | imagio Neo 450 modified version | Heated |

TABLE 1-continued

| Example No. | Toner | $(W_{100} - W_0)/W_{100}$ | Copying machine | Photo-conductor |
|---|---|---|---|---|
| Ref. Ex. 1 | Toner 1 | 0.26 | imagio Neo 450 modified version | Heated |
| Ref. Ex. 2 | Toner 2 | 0.15 | imagio Neo 450 modified version | Heated |
| Ref. Ex. 3 | Toner 3 | 0.1 | imagio Neo 450 modified version | Heated |
| Ref. Ex. 4 | Toner 4 | 0.05 | imagio Neo 450 modified version | Heated |
| Comp. Ex. 3 | Comp. Toners 2–5 | Average 0.36 | Aficio AP3800C | Not heated |
| Ex. 5 | Toners 5–8 | Average 0.11 | Aficio AP3800C | Not heated |
| Comp. Ex. 4 | Comp. Toners 2–5 | Average 0.36 | Aficio AP3800C modified version | Heated |
| Comp. Ex. 5 | Comp. Toners 5–8 | Average 0.11 | Aficio AP3800C modified version | Heated |

TABLE 2

| Example No. | Toner | Image blur | Lower limit | Offset temper-ature | Fixable range | EFR |
|---|---|---|---|---|---|---|
| Comp. Ex. 1a | Comp. Toner 1a | 1 | 180 | 180 | 0 | 162 |
| Comp. Ex. 1b | Comp. Toner 1b | 2 | 175 | 185 | 10 | 125 |
| Comp. Ex. 1c | Comp. Toner 1c | 3 | 170 | 190 | 20 | 101 |
| Ex. 1 | Toner 1 | 4 | 160 | 190 | 30 | 75 |
| Ex. 2 | Toner 2 | 5 | 165 | 195 | 30 | 56 |
| Ex. 3 | Toner 3 | 5 | 160 | 240 | 80 | 48 |
| Ex. 4 | Toner 4 | 5 | 160 | 195 | 35 | 26 |
| Comp. Ex. 2a | Comp. Toner 1a | 4 | 180 | 185 | 5 | 153 |
| Comp. Ex. 2b | Comp. Toner 1b | 4 | 180 | 185 | 5 | 125 |
| Comp. Ex. 2c | Comp. Toner 1c | 5 | 175 | 190 | 15 | 101 |
| Ref. Ex. 1 | Toner 1 | 5 | 165 | 190 | 25 | 75 |
| Ref. Ex. 2 | Toner 2 | 5 | 165 | 195 | 30 | 52 |
| Ref. Ex. 3 | Toner 3 | 5 | 160 | 240 | 80 | 44 |
| Ref. Ex. 4 | Toner 4 | 5 | 160 | 195 | 35 | 25 |
| Comp. Ex. 3 | Comp. Toners 2–5 | 1 | 150 | 180 | 30 | 108 |
| Ex. 5 | Toners 5–8 | 5 | 130 | 200 | 70 | 42 |
| Comp. Ex. 4 | Comp. Toners 2–5 | 4 | 155 | 180 | 25 | 95 |
| Comp. Ex. 5 | Toners 5–8 | 5 | 130 | 195 | 65 | 33 |

EFR: Environmental fluctuation rate

Example 6

Toner 3 obtained in the preparation example were added to 100 g of ion-exchanged water in which 10 g of sodium dodecylbenzene sulphonate had been dissolved with stirring and dispersed until the toner particles got sufficiently wet. The stirring was continued for another about 5 hours, and the mixture was then filtered. The filter cake was added to 100 g of ion-exchanged water with stirring and dispersed therein. This was then filtered and the filter cake was dried to obtain Toner 6 having a reduced external additive content. The value of $(W_{100}-W_0)/W_{100}$ was 0.05, wherein $W_0$ and $/W_{100}$ are the water wettabilities of Toner 6 and the toner 3, respectively. In Toner 6, the reduction rates of silica and titanium oxide were 52% and 45%, respectively. Toner 6 was evaluated in the same manner as in Example 3. The results were as follows.

Image blur: 5
Fixing lower limit temperature: 155° C.
Offset temperature: 240° C.
Environmental fluctuation rate: 51%.

Comparative Example 6

A toner was prepared in the same manner as the toner 3 except that no sodium hydroxide was added before the removal of the solvent. The toner was added to 100 g of ion-exchanged water in which 10 g of sodium dodecylbenzene sulphonate had been dissolved with stirring and dispersed until the toner particles got sufficiently wet. The stirring was continued for another about 5 hours, and the mixture was then filtered. The filter cake was added to 100 g of ion-exchanged water with stirring and dispersed therein. This was then filtered and the filter cake was dried to obtain a comparative toner 6 having a reduced external additive content. The vale of $(W_{100}-W_0)/W_{100}$ was 0.53, wherein $W_0$ and $/W_{100}$ are the water wettabilities of Comparative Toner 6 and Toner 3, respectively. In Comparative Toner 6, the reduction rates of silica and titanium oxide were 55% and 41%, respectively. Comparative Toner 6 was evaluated in the same manner as in Example 3. The results were as follows.

Image blur: 1
Fixing lower limit temperature: 165° C.
Offset temperature: 220° C.
Environmental fluctuation rate: 138%.

What is claimed is:

1. A toner for developing an electrostatic image, comprising toner particles each containing at least a colorant and a resin, and an external additive present on each of said toner particles, wherein the water wettability of said toner particles without said external additive is $W_0$, wherein the water wettability of said toner is $W_{100}$, and wherein $(W_{100}-W_0)/W_{100}$ is not greater than 0.3.

2. A toner for developing an electrostatic image, comprising toner particles each containing at least a colorant and a resin, and an external additive present on each of said toner particles, wherein the water wettability of said toner particles from which greater than 0% and not greater than 50% of said external additive is removed is $W_{50}$, wherein the water wettability of said toner is $W_{100}$, and wherein $(W_{100}-W_{50})/W_{100}$ is not greater than 0.3.

3. A toner for developing an electrostatic image, comprising toner particles each containing at least a colorant and a resin, and an external additive present on each of said toner particles, wherein the water wettability of said toner particles from which greater than 50% and not greater than 70% of said external additive is removed is $W_{30}$, wherein the water wettability of said toner is $W_{100}$, and wherein $(W_{100}-W_{30})/W_{100}$ is not greater than 0.3.

4. A toner as claimed in claim 1, wherein said toner particles are prepared by dispersing a solution or dispersion, formed by dissolving or dispersing a toner composition comprising at least a colorant and a resin in an organic solvent, in an aqueous medium to obtain a dispersion, and removing said organic solvent from the thus obtained dispersion.

5. A toner as claimed in claim 1, wherein said toner particles are prepared by dispersing a solution or dispersion, formed by dissolving or dispersing a toner composition comprising at least a colorant and a resin in an organic solvent, in an aqueous medium containing a solid fine particle dispersing agent to obtain an emulsified dispersion, and removing said organic solvent from the thus obtained emulsified dispersion liquid.

6. A toner as claimed in claim 5, wherein said solid fine particle dispersing agent is resin fine particles.

7. A toner as claimed in claim 1, wherein said toner particles are prepared by dispersing a solution or dispersion, formed by dissolving or dispersing a toner composition comprising at least a colorant, a resin and a reactive prepolymer in an organic solvent, in an aqueous medium to obtain a solution or dispersion, subjecting said solution or dispersion to a polyaddition reaction with a compound having at least two functional groups capable of reacting with said reactive prepolymer, and removing said organic solvent from the thus obtained dispersion.

8. A toner as claimed in claim 1, wherein said resin contains a modified polyester having a urea bond or a urethane bond.

9. A toner as claimed in claim 1, further comprising charge controlling agent particles present on each of said toner particles.

10. A toner as claimed in claim 1, wherein said external additive comprises hydrophobized silica or hydrophobized titanium oxide.

11. An electrostatic image developing method, comprising developing an electrostatic latent image formed on a surface of a photoconductor which does not have a function of maintaining said surface at a temperature of 30° C. or higher with a developer containing a toner according to claim 1 in a developing device having a developing roll and a developing blade for making the thickness of developer supplied on said developing roll uniform.

12. A developing method as claimed in claim 11, wherein said resin comprises a modified polyester having a urea bond and/or a urethane bond.

13. A developing method as claimed in claim 11, wherein said toner further comprises charge controlling agent particles present on each of said toner particles.

14. A developing method as claimed in claim 11, wherein said external additive contains hydrophobized silica or hydrophobized titanium oxide.

15. An electrostatic image developing method comprising developing an electrostatic latent image formed on a surface of a photoconductor which does not have a function of maintaining said surface at a temperature of 30° C. or higher with a developer containing a toner according to claim 4 in a developing device having a developing roll and a developing blade for making the thickness of developer supplied on said developing roll uniform.

16. A developing method as claimed in claim 15, wherein said resin comprises a modified polyester having a urea bond and/or a urethane bond.

17. A developing method as claimed in claim 15, wherein said toner further comprises charge controlling agent particles present on each of said toner particles.

18. A developing method as claimed in claim 15, wherein said external additive contains hydrophobized silica or hydrophobized titanium oxide.

19. An electrostatic image developing method comprising developing an electrostatic latent image formed on a surface of a photoconductor which does not have a function of maintaining said surface at a temperature of 30° C. or higher with a developer containing a toner according to claim 5 in a developing device having a developing roll and a developing blade for making the thickness of developer supplied on said developing roll uniform.

20. A developing method as claimed in claim 19, wherein said resin comprises a modified polyester having a urea bond and/or a urethane bond.

21. A developing method as claimed in claim 19, wherein said toner further comprises charge controlling agent particles present on each of said toner particles.

22. A developing method as claimed in claim 19, wherein said external additive contains hydrophobized silica or hydrophobized titanium oxide.

23. An electrostatic image developing method comprising developing an electrostatic latent image formed on a surface of a photoconductor which does not have a function of maintaining said surface at a temperature of 30° C. or higher with a developer containing a toner according to claim 7 in a developing device having a developing roll and a developing blade for making the thickness of developer supplied on said developing roll uniform.

24. A developing method as claimed in claim 23, wherein said resin comprises a modified polyester having a urea bond and/or a urethane bond.

25. A developing method as claimed in claim 23, wherein said toner further comprises charge controlling agent particles present on each of said toner particles.

26. A developing method as claimed in claim 23, wherein said external additive contains hydrophobized silica or hydrophobized titanium oxide.

27. A developing method comprising developing a plurality of color-separated electrostatic latent images formed on a surface of a photoconductor which does not have a function of maintaining said surface at a temperature of 30° C. or higher with developers each containing a toner corresponding to the respective color in a developing device having a developing roll and a developing blade for making the thickness of developer supplied on said developing roll uniform, wherein said toner is according to claim 1.

28. A developing method as claimed in claim 27, wherein said resin contains a modified polyester having a urea bond and/or a urethane bond.

29. A developing method as claimed in claim 27, wherein said toner further comprises charge controlling agent particles present on each of said toner particles.

30. A developing method as claimed in claim 27, wherein said external additive contains hydrophobized silica or hydrophobized titanium oxide.

31. A developing method comprising developing a plurality of color-separated electrostatic latent images formed on a surface of a photoconductor which does not have a function of maintaining said surface at a temperature of 30° C. or higher with developers each containing a toner corresponding to the respective color in a developing device having a developing roll and a developing blade for making the thickness of developer supplied on said developing roll uniform, wherein said toner is according to claim 4.

32. A developing method as claimed in claim 31, wherein said resin comprises a modified polyester having a urea bond and/or a urethane bond.

33. A developing method as claimed in claim 31, wherein said toner further comprises charge controlling agent particles present on each of said toner particles.

34. A developing method as claimed in claim 31, wherein said external additive contains hydrophobized silica or hydrophobized titanium oxide.

35. A developing method comprising developing a plurality of color-separated electrostatic latent images formed on a surface of a photoconductor which does not have a function of maintaining said surface at a temperature of 30° C. or higher with developers each containing a toner corresponding to the respective color in a developing device having a developing roll and a developing blade for making the thickness of developer supplied on said developing roll uniform, wherein said toner is according to claim 5.

36. A developing method as claimed in claim 35, wherein said resin comprises a modified polyester having a urea bond and/or a urethane bond.

37. A developing method as claimed in claim 35, wherein said toner further comprises charge controlling agent particles present on each of said toner particles.

38. A developing method as claimed in claim 35, wherein said external additive contains hydrophobized silica or hydrophobized titanium oxide.

39. A developing method comprising developing a plurality of color-separated electrostatic latent images formed on a surface of a photoconductor which does not have a function of maintaining said surface at a temperature of 30° C. or higher with developers each containing a toner corresponding to the respective color in a developing device having a developing roll and a developing blade for making the thickness of developer supplied on said developing roll uniform, wherein said toner is according to claim 7.

40. A developing method as claimed in claim 39, wherein said resin comprises a modified polyester having a urea bond and/or a urethane bond.

41. A developing method as claimed in claim 39, wherein said toner further comprises charge controlling agent particles present on each of said toner particles.

42. A developing method as claimed in claim 39, wherein said external additive contains hydrophobized silica or hydrophobized titanium oxide.

43. A method for producing a toner for developing an electrostatic image, comprising the steps of dispersing a solution or dispersion, formed by dissolving or dispersing a toner composition comprising at least a colorant and a resin in an organic solvent, in an aqueous medium to obtain a dispersion, removing said organic solvent from the thus obtained dispersion to obtain powder particles having a water wettability of $W_0$, and mixing said powder particles with an external additive to obtain a toner having a water wettability of $W_{100}$, wherein $(W_{100}-W_0)/W_{100}$ is not greater than 0.3.

44. A production method as claimed in claim 43, wherein said resin contains a modified polyester having a urea bond and/or a urethane bond.

45. A method for producing a toner for developing an electrostatic image, comprising the steps of dispersing a solution or dispersion, formed by dissolving or dispersing a toner composition comprising at least a colorant and a resin in an organic solvent, in an aqueous medium containing a solid fine particle dispersing agent to obtain a dispersion, removing said organic solvent from the thus obtained dispersion to obtain powder particles having a water wettability of $W_0$, and mixing said powder particles with an external additive to obtain a toner having a water wettability of $W_{100}$, wherein $(W_{100}-W_0)/W_{100}$ is not greater than 0.3.

46. A production method as claimed in claim 43, wherein said resin contains a modified polyester having a urea bond and/or a urethane bond.

47. A method for producing a toner for developing an electrostatic image, comprising the steps of dispersing a solution or dispersion, formed by dissolving or dispersing a toner composition comprising at least a colorant, a resin and a reactive prepolymer in an organic solvent, in an aqueous medium to obtain a solution or dispersion, subjecting said solution or dispersion to a polyaddition reaction with a compound having at least two functional groups capable of reacting with said reactive prepolymer to obtain a dispersion, and removing said organic solvent from the thus obtained dispersion to obtain powder particles having a water wettability of $W_0$, and mixing said powder particles with an external additive to obtain a toner having a water wettability of $W_{100}$, wherein $(W_{100}-W_0)/W_{100}$ is not greater than 0.3.

48. A production method as claimed in claim 47, wherein said resin contains a modified polyester having a urea bond and/or a urethane bond.

49. A method for producing a toner for developing an electrostatic image, comprising the steps of dispersing a solution or dispersion, formed by dissolving or dispersing a toner composition comprising at least a colorant and a resin in an organic solvent, in an aqueous medium to obtain a dispersion, removing said organic solvent from the thus obtained dispersion to obtain powder particles having a water wettability of $W_0$, and mixing said powder particles with charge controlling agent particles and external additive particles to obtain a toner having a water wettability of $W_{100}$, wherein $(W_{100}-W_0)/W_{100}$ is not greater than 0.3.

* * * * *